US008555554B2

(12) United States Patent
Koch et al.

(10) Patent No.: US 8,555,554 B2
(45) Date of Patent: Oct. 15, 2013

(54) SEATING SYSTEM

(75) Inventors: Joshua Koch, Clare, MI (US); Brian Staten, Clare, MI (US)

(73) Assignee: Stageright Corporation, Clare, MI (US)

( * ) Notice: Subject to any disclaimer, the term of this patent is extended or adjusted under 35 U.S.C. 154(b) by 0 days.

(21) Appl. No.: 13/315,657

(22) Filed: Dec. 9, 2011

(65) Prior Publication Data

US 2012/0317890 A1 Dec. 20, 2012

Related U.S. Application Data

(60) Provisional application No. 61/421,745, filed on Dec. 10, 2010.

(51) Int. Cl.
*E04H 3/12* (2006.01)

(52) U.S. Cl.
CPC ..... *E04H 3/123* (2013.01)
USPC ..... 52/10

(58) Field of Classification Search
USPC ..... 52/6, 7, 8, 9, 10, 36.1; 182/223; 472/92
See application file for complete search history.

(56) References Cited

U.S. PATENT DOCUMENTS

| | | | | |
|---|---|---|---|---|
| 3,881,140 | A * | 4/1975 | Hartman | 318/85 |
| 5,050,353 | A | 9/1991 | Rogers et al. | |
| 5,517,091 | A * | 5/1996 | Becher et al. | 318/49 |
| 6,014,936 | A | 1/2000 | Rogers et al. | |
| 6,199,325 | B1 * | 3/2001 | Winship | 52/10 |
| D459,003 | S | 6/2002 | Hallberg | |
| 6,415,551 | B1 * | 7/2002 | Norman | 52/10 |
| 6,598,351 | B2 | 7/2003 | Hallberg | |
| 7,584,575 | B2 | 9/2009 | Hallberg | |
| 7,900,402 | B2 * | 3/2011 | Staten et al. | 52/10 |
| 2008/0083170 | A1 * | 4/2008 | Staten et al. | 52/10 |
| 2010/0183388 | A1 * | 7/2010 | Chiu | 408/1 R |
| 2011/0099915 | A1 * | 5/2011 | Sudkamp et al. | 52/9 |

* cited by examiner

*Primary Examiner* — William Gilbert
*Assistant Examiner* — Kyle Walraed-Sullivan
(74) *Attorney, Agent, or Firm* — Carlson, Gaskey & Olds P.C.

(57) ABSTRACT

An example of the disclosed seating system includes a plurality of seating risers configured to telescope relative to one another, and at least one of the seating risers is a powered seating riser configured to deploy and retract the seating risers. Further included is a control pendant. The powered seating riser is drivable in response to said control pendant.

10 Claims, 25 Drawing Sheets

SEATING SYSTEM

RELATED APPLICATIONS

This application claims priority to U.S. Provisional Application No. 61/421,745, filed Dec. 10, 2010.

BACKGROUND

The present disclosure relates to portable seating systems and more particularly to a powered telescopic seating riser.

Seating risers are designed for use in auditoriums, gymnasiums, and event halls, as examples, to accommodate spectators on portable seats, such as folding chairs, or on seats affixed to the risers. Certain facilities may require seating risers that are capable of being moved between a retracted position for storage and a deployed position for use.

SUMMARY

Disclosed is a seating system including a plurality of seating risers configured to telescope relative to one another, and at least one of the seating risers is a powered seating riser configured to deploy and retract the seating risers. Further included is a control pendant. The powered seating riser is drivable in response to said control pendant.

Further included is a seating bank including first and second seating systems. Each of the seating systems includes a plurality of seating risers configured to telescope relative to one another by way of a respective powered seating riser. The first and second seating systems each further include a respective port. A receiver is selectively attachable to each of these ports, and the receiver is configured to communicate a signal from a control pendant to a respective one of the first and second seating systems.

These and other features of the present disclosure can be best understood from the following drawings and detailed description.

BRIEF DESCRIPTION OF THE DRAWINGS

The drawings can be briefly described as follows.

DETAILED DESCRIPTION

Figure 8B:
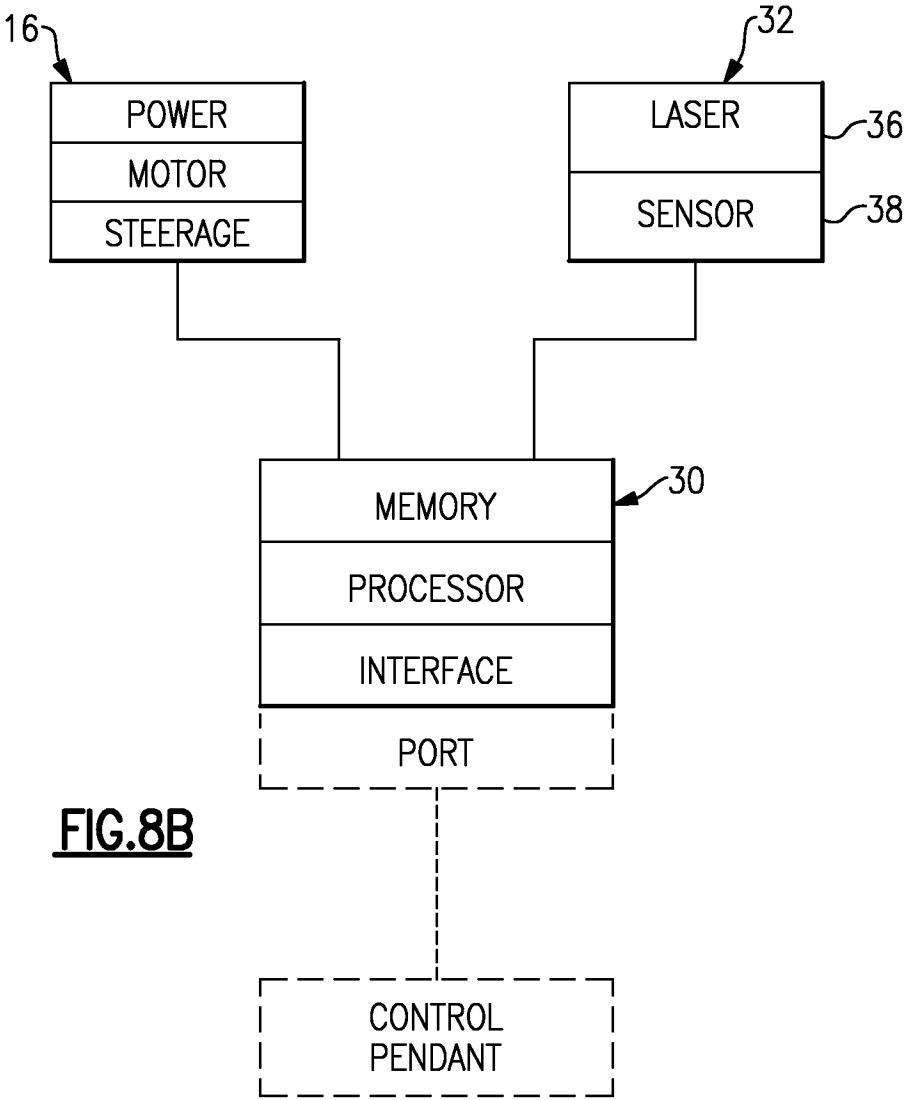
FIG. 8B is illustrative of the high-level components within the system of FIG. 8B.

An exemplary seating system 10 has a multiple of telescopic seating risers 12A-12F configured to deploy (see FIG. 1A) and retract (schematically represented in FIG. 1B) relative to one another. While six seating risers 12A-12F are shown, it should be understood that this application extends to seating systems with any number of risers. This is represented in certain illustrations with reference numeral 12N, where the $N^{th}$ seating riser is an aft-most seating riser. For example, in FIGS. 8D-8E, any number of seating risers can be positioned between the front-most seating riser 12A and the aft-most seating riser 12N.

Figure 2:
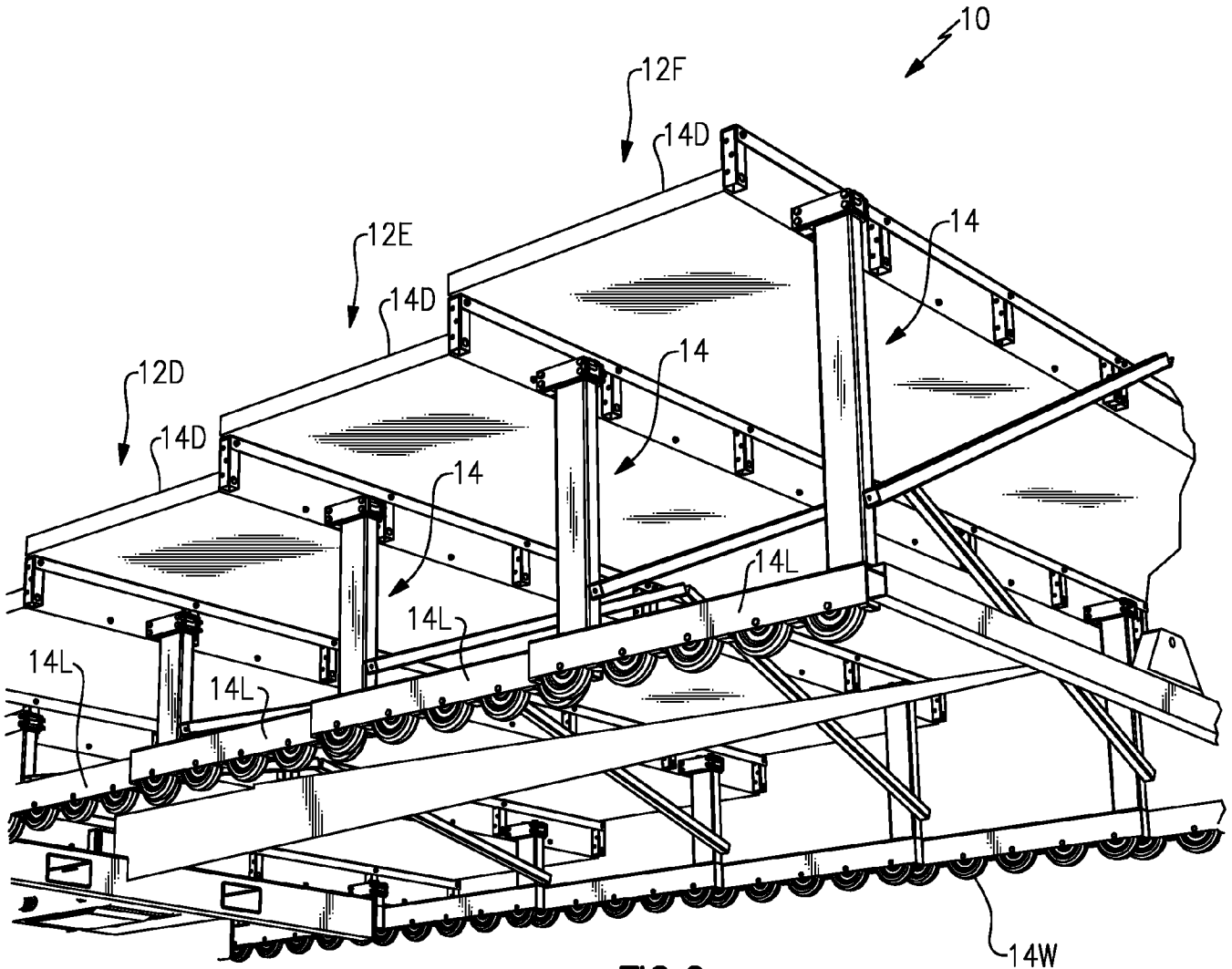
FIG. 2 is a rear-perspective view of the seating system.
Figure 18A:
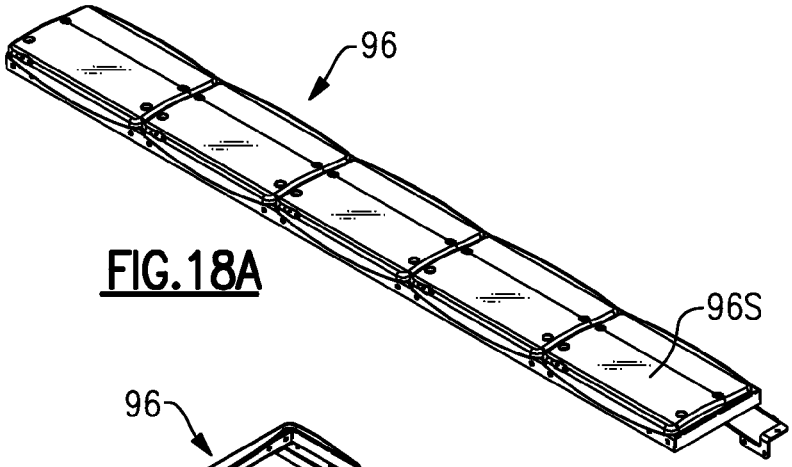
FIGS. 18A-18B are perspective views of a seating bench.
Figure 18B:
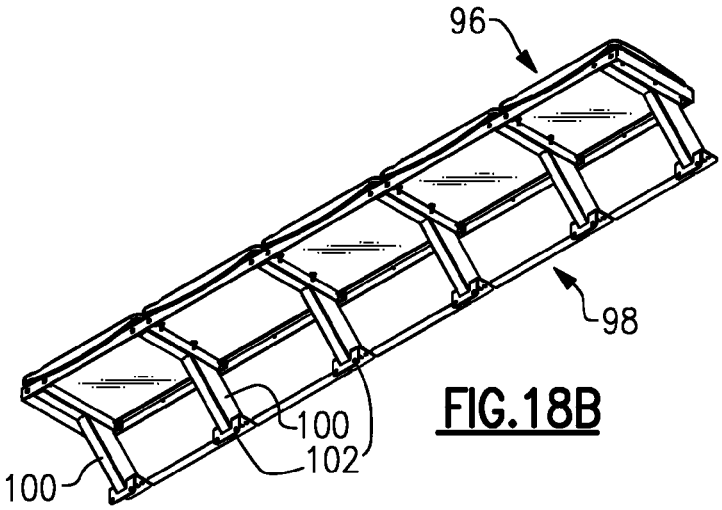

With reference to FIG. 2, each seating riser 12A-12F generally includes a support structure 14 which supports a respective deck 14D above a multiple of legs 14L which support a number of rollers 14W. The decks 14D may support spectators thereon, either directly, such as when spectators stand directly on the decks 14D, or indirectly by way of fixed benches (e.g., FIGS. 18A-B) or removable seats, such as folding chairs.

Figures 1A, 1B:
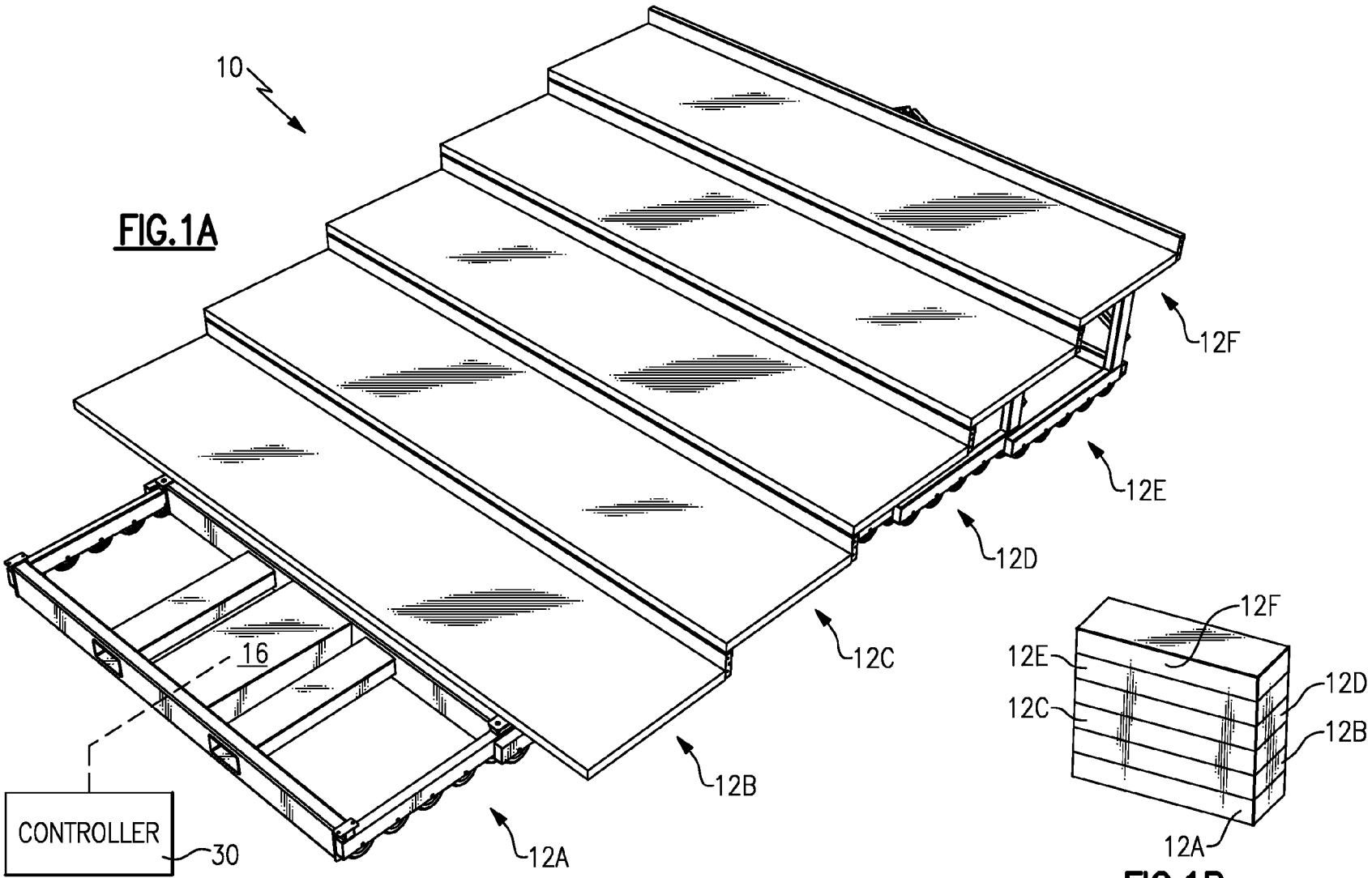
FIG. 1A is a perspective view of a seating system in a deployed position.
FIG. 1B is a schematic illustration of the seating system in a retracted position.

It should be understood that the support structure 14 may be of various configurations. In one example, the lower level seating risers are narrower in width and shorter in height relative to the upper level seating risers (e.g., lowest level seating riser 12A is narrower in width and shorter in height relative to seating riser 12B, and so on) to facilitate telescoping of the seating system 10 between the deployed (FIG. 1A) and retracted positions (FIG. 1B).

At least one of the seating risers is a powered seating riser including a belt drive system 16. The powered seating riser is operable to drive the deployment and retraction the seating system 10, and to further steer the seating risers 12A-12F during deployment and retraction. In the disclosed non-limiting embodiment the lowest riser 12A is the powered seating riser. Although any of the seating risers 12A-12F may be a powered seating riser, the lowest riser 12A may best facilitate steering of the seating risers 12A-12F.

Figure 3:
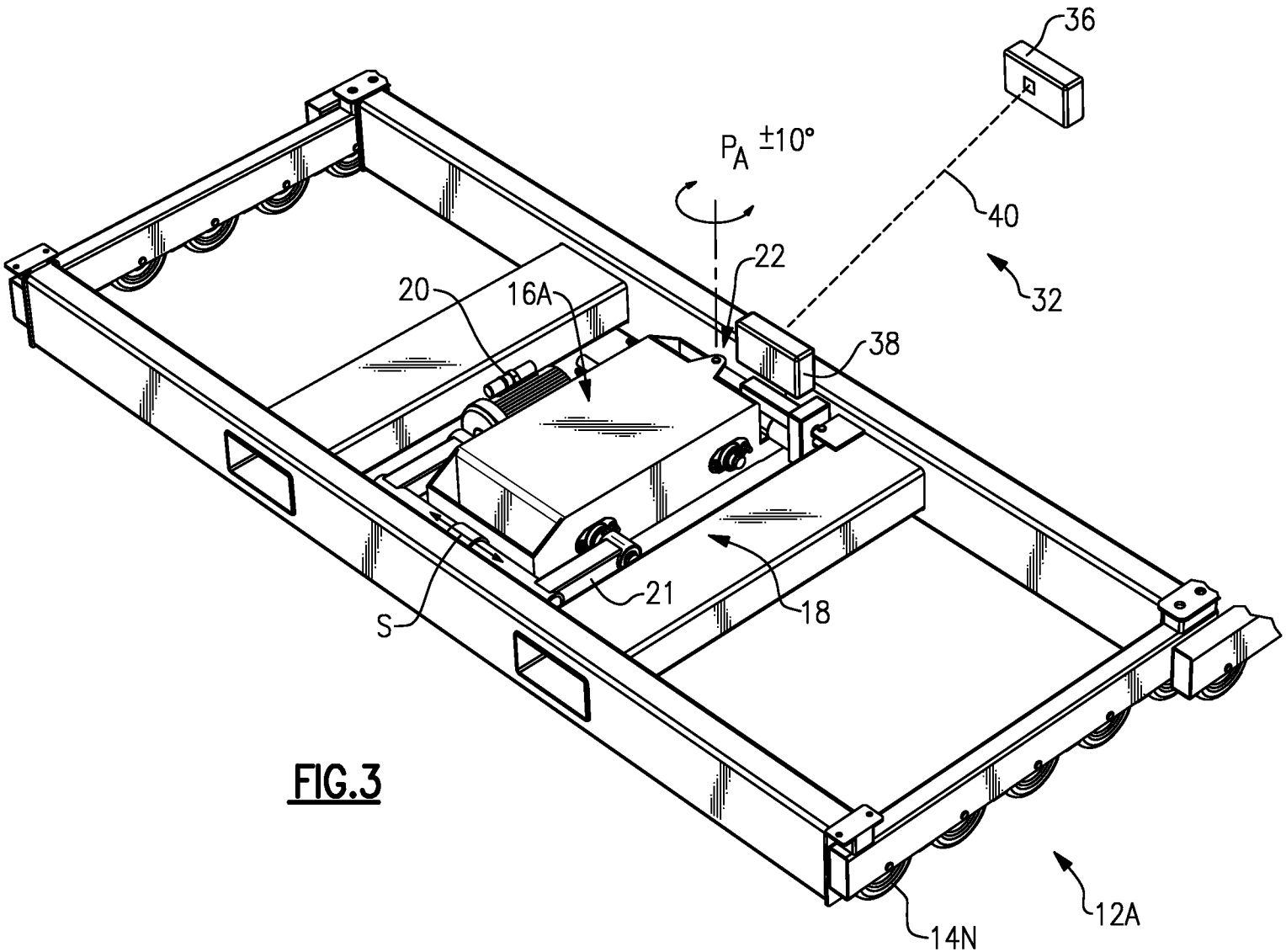
FIG. 3 is a top-perspective view of an embodiment of a powered seating riser including a single-belt drive system.
Figure 4:
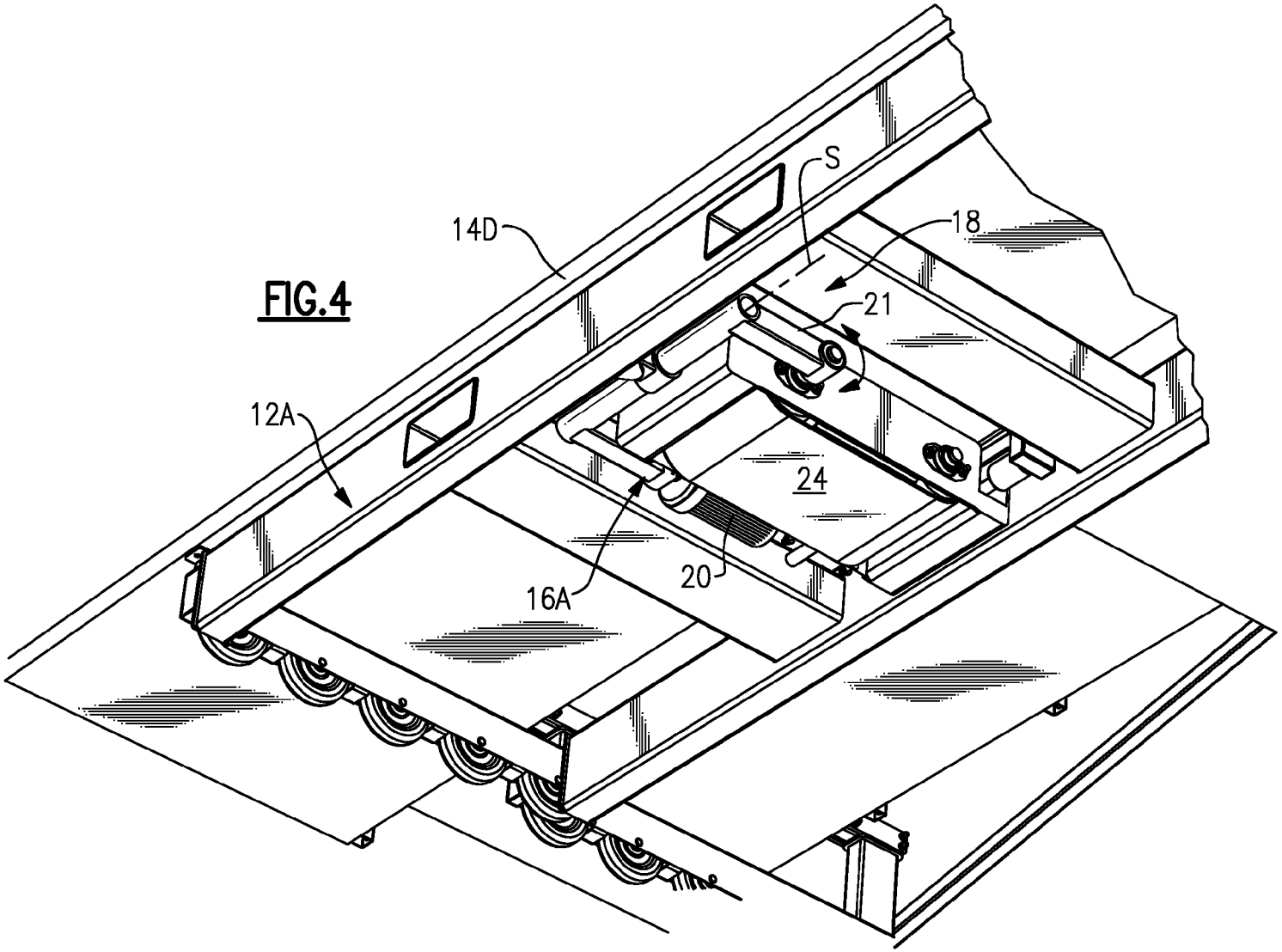
FIG. 4 is a bottom-perspective view of a powered seating riser of FIG. 3.
Figure 5A:
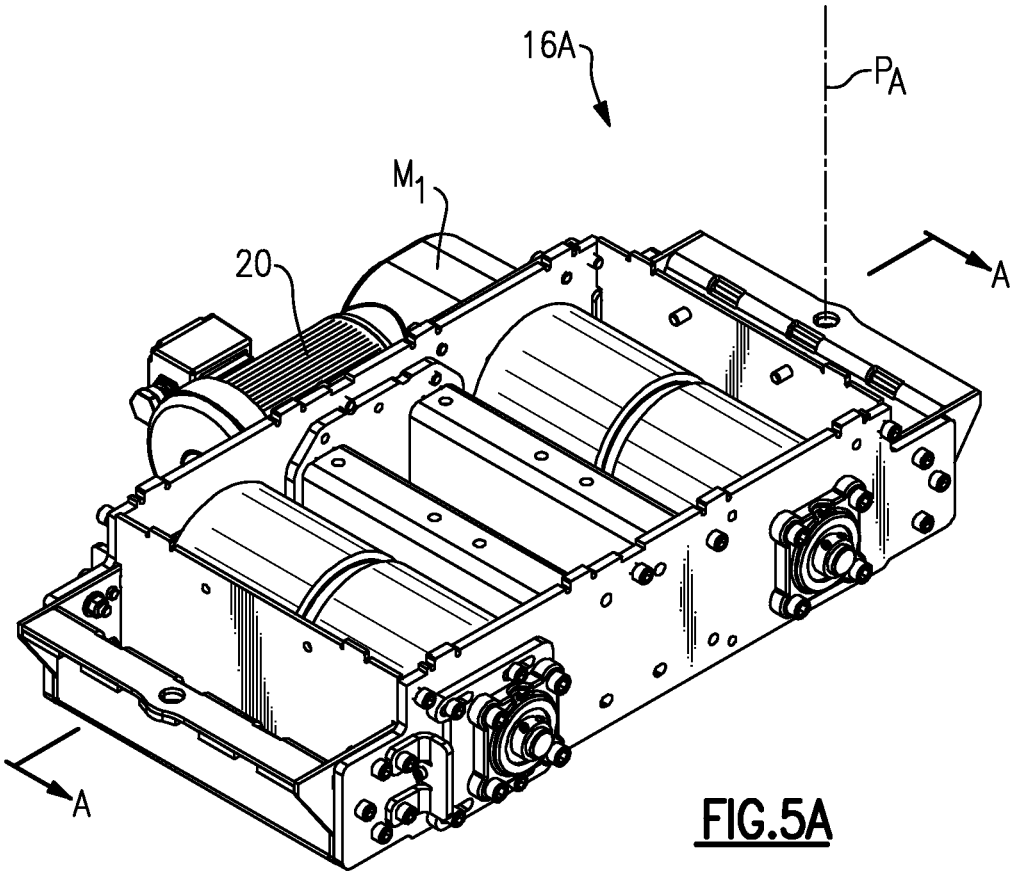
FIG. 5A illustrates the single-belt drive system of FIG. 3 with the belt removed.
Figure 5B:
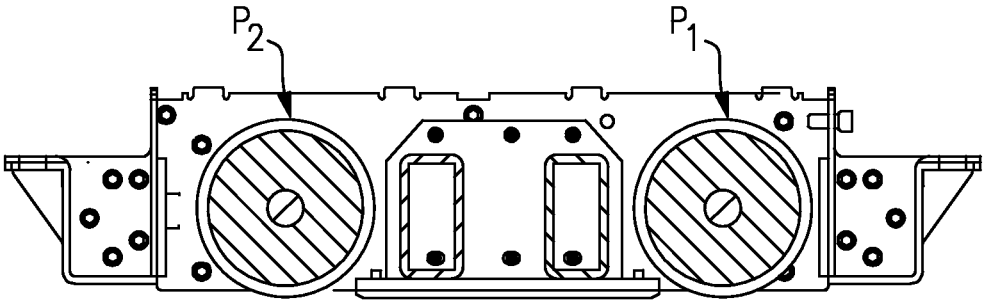
FIG. 5B is a sectional view taken along line A-A.

It should be understood that the powered seating riser 12A may include a deck 14D (as in FIG. 4), or the powered seating riser 12A may only provide the motive force without a deck 14D (as in FIG. 3).

Belt Dive System

Figure 6:
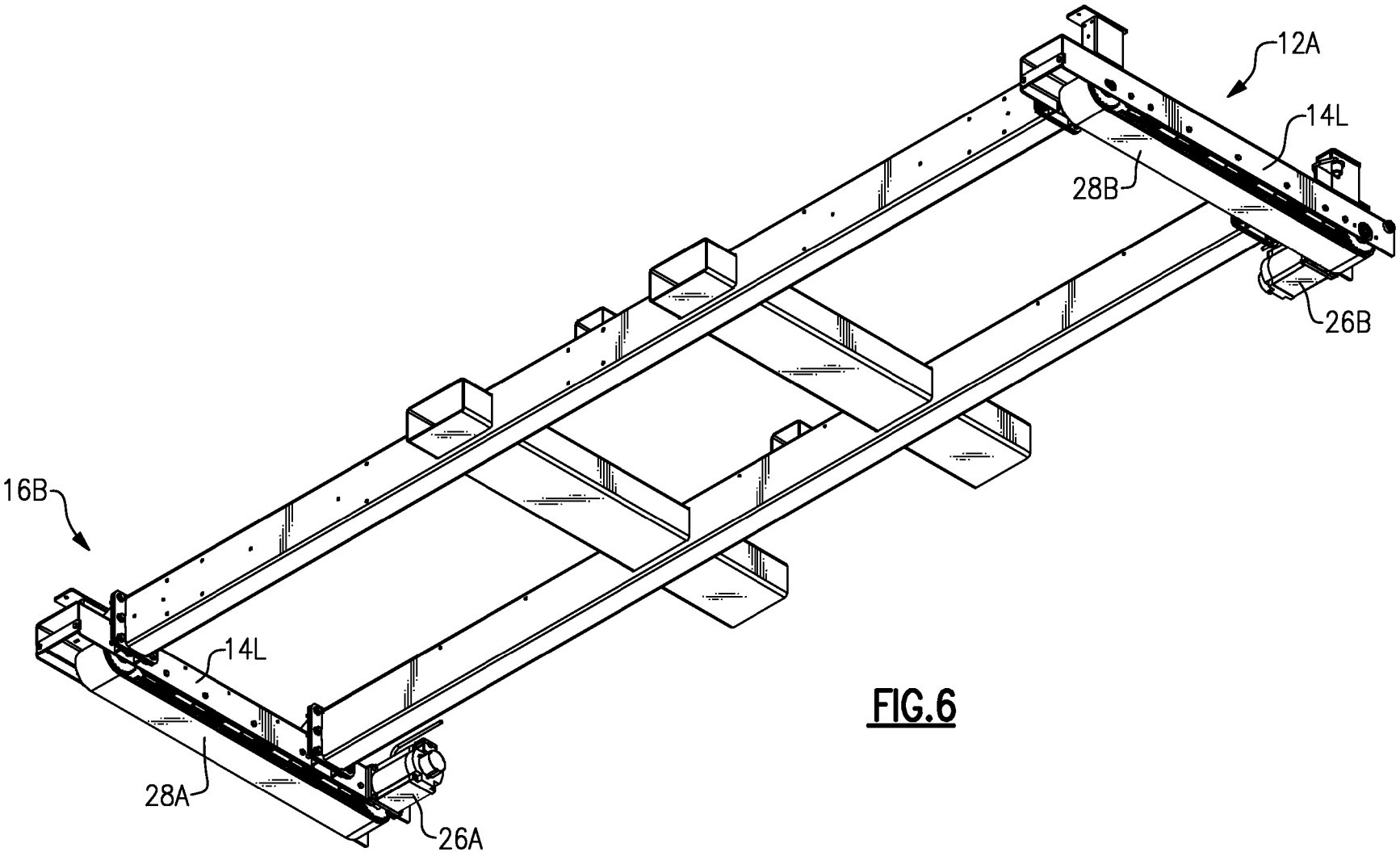
FIG. 6 is a bottom-perspective view of an embodiment of a powered seating riser including a dual-belt drive system.

In one disclosed non-limiting embodiment, the belt drive system 16 is a single-belt drive system 16A generally depicted within the powered seating riser 12A (FIG. 3). In another disclosed non-limiting embodiment, the drive system 16 is a dual-belt drive system 16B located along the flanks of the powered seating riser 12A (FIG. 6). Each of the drive systems 16A-16B provides the motive force for deployment and retraction of the seating system 10, as well as steerage of the seating system 10 during deployment and retraction.

With reference to FIGS. 3-5B, the single-belt drive system 16A includes a steering mechanism 18 which generally includes an actuator arrangement 20 which pivots the single-belt drive system 16A about a pivot arrangement 22 to provide steerage about an axis $P_A$.

The steering mechanism 18 may further incorporate a suspension arm system 21 which allows the single-belt drive system 16A to pivot about an axis S to facilitate contact with an uneven ground surface.

In this non-limiting embodiment, the drive system includes a single belt 24 driven by a motor $M_1$ via a plurality of rollers, or pulleys, $P_1$, $P_2$. The significant surface contact provided by belt 24 facilitates the deployment and retraction of the system 10 over uneven or relatively slick terrain, such as arena surfaces. Further, it should be understood that various suspension or articulation systems may alternatively or additionally be provided to assure contact of the belt 24 with uneven terrain.

Figure 7A:
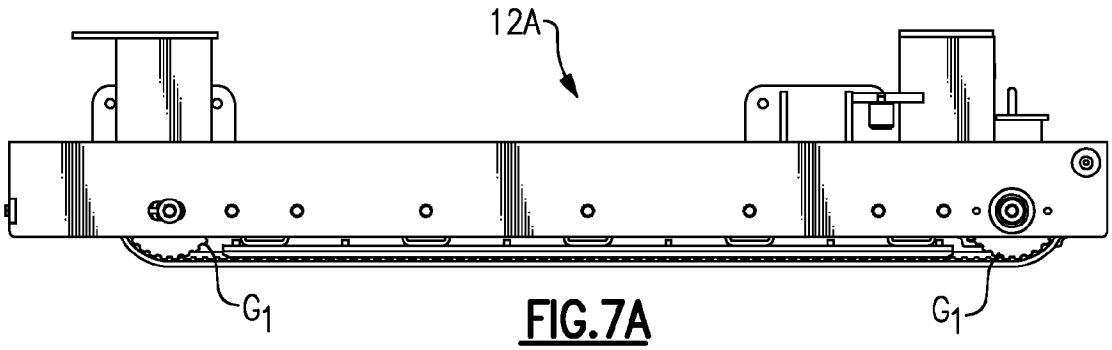
FIG. 7A is a side view of one of the drives within the dual-belt drive system of FIG. 6.
Figure 7C:
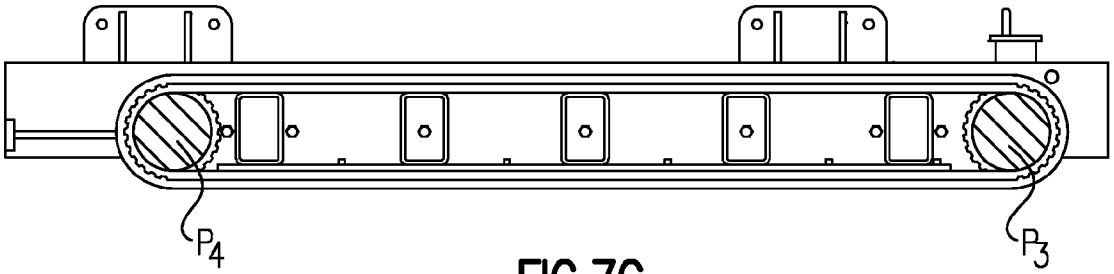
FIG. 7C is a sectional view taken along line B-B.
Figure 7B:
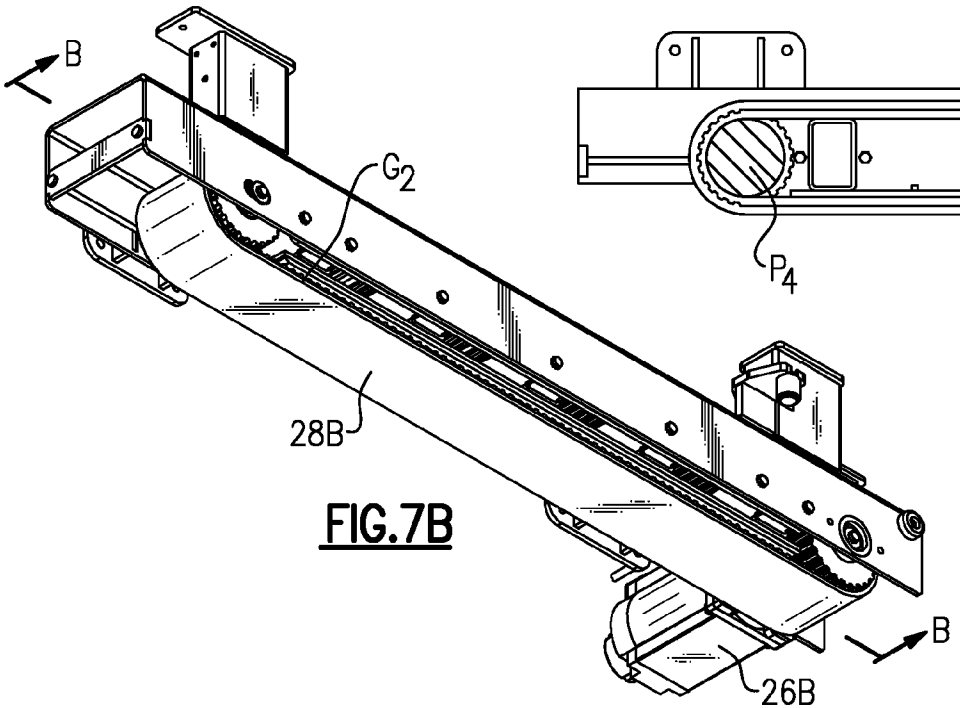
FIG. 7B is a bottom-perspective view of the drive of FIG. 7A.

With reference to FIGS. 6-7C, the dual-belt drive system 16B includes two variable frequency motors, or drives, 26A-26B, each driving a respective belt, or track, 28A-28B. Conceptually, the dual-belt system 14B provides the seating system with a motive force, as well as steering, in a "tank-like" manner. To this end, the variable frequency drives may be disposed at opposite sides, or flanks, of the powered seating riser 12A within the legs 14L thereof, as depicted in FIG. 6.

In this embodiment, each of the variable frequency drives 26A-26B includes a plurality of rollers, or pulleys, $P_3$, $P_4$, one of which may be a timing pulley and the other of which is an idler pulley. The pulleys $P_3$, $P_4$ may include grooves $G_1$ corresponding to grooves $G_2$ within the respective belts 28A-28B for engagement therewith. The belts 28A-28B in this example are each 4 inches (10.16 cm) wide and provide a 35 inch (88.9 cm) contact area with a ground surface (such as a gymnasium floor).

Control System/Logic

The belt drive system 16 is operable to deploy and retract the seating system 10, as well as steer the powered seating riser 12A. This steerage is controlled by a controller 30 (schematically shown in FIGS. 8A-8B) to prevent binding, or jamming, of the seating risers 12A-12F relative to one another during deployment and retraction. That is, the drive system 16 is controlled such that the powered seating riser 12A steers the seating system 10 to prevent, or correct, binding of the seating risers 12A-12F without the need for manual human intervention.

The controller 30 is operable to monitor the retraction and deployment of the seating risers 12A-12F to identify alignment and misalignment conditions. In an alignment condition, the powered seating risers move without binding. A misalignment condition, on the other hand, indicates either an actual misalignment between one or more of the seating risers 12A-12F, or a potential misalignment thereof. When a misalignment condition is identified, the controller 30 provides corrective steering instructions to the powered seating riser 12A.

Figure 8A:
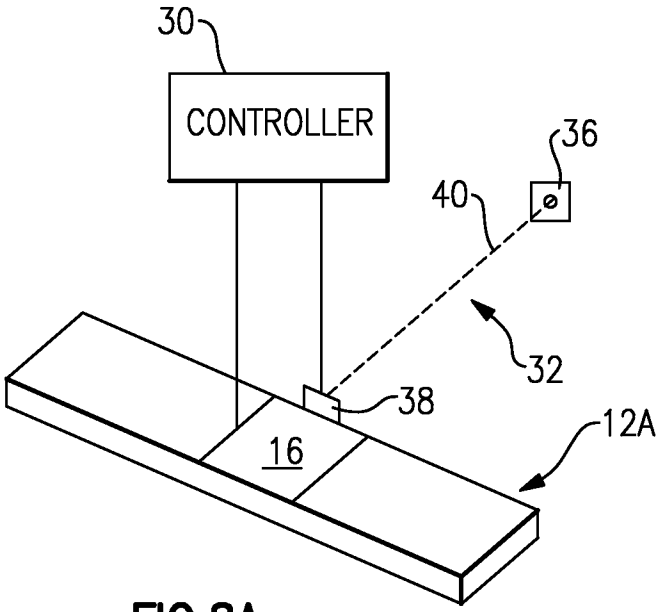
FIG. 8A is a illustrates the relationship between the belt disclosed belt drive systems, a controller, and a laser/sensor feedback loop.

In order to monitor the movement of the seating risers 12A-12F, the controller 30 is in communication with a laser/sensor feedback loop 32, as illustrated schematically in FIG. 8A. The laser/sensor feedback loop includes a laser 36 and a sensor 38. The laser 36 may be located on the aft-most, or highest level, seating riser 12N (FIG. 8C) and the sensor 38 may be located on the powered seating riser 12A, or vice-versa (FIG. 8D), such that a laser beam 40 which is transmitted therebetween. The laser 36 may alternatively be located on a structure adjacent the aft-most seating riser 12N (such as the post $W_P$ of FIG. 8E) or directly on a wall W adjacent the aft-most seating riser 12N (as in FIG. 8F), with the sensor 38 located on the powered seating riser 12A, or vice-versa. That is, the laser 36 may be a self-contained module separately positioned from the seating risers 12A-12N. The laser 36 may further be powered independent from the controller 30 and the sensor 38. These examples are non-limiting, and the laser 36 and sensor 38 may be positioned at other locations.

Figure 8C:
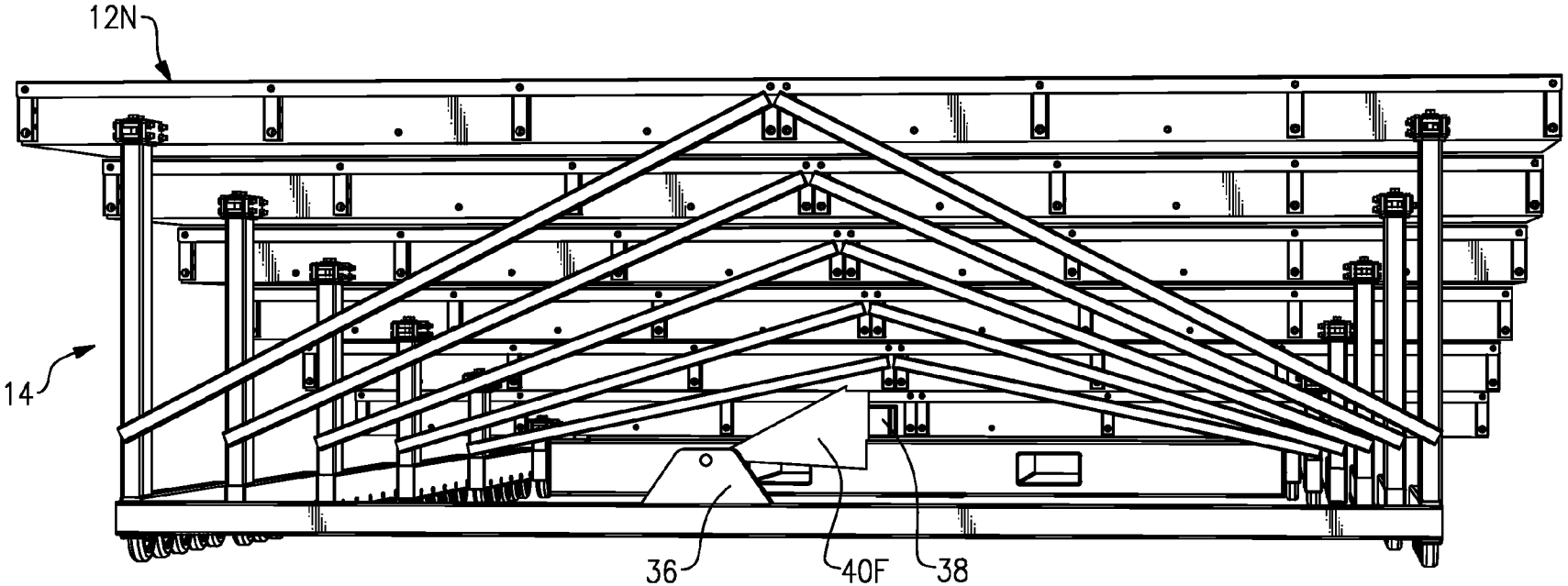
FIGS. 8C-8F illustrate exemplary laser/sensor feedback loop configurations.
Figure 8D:
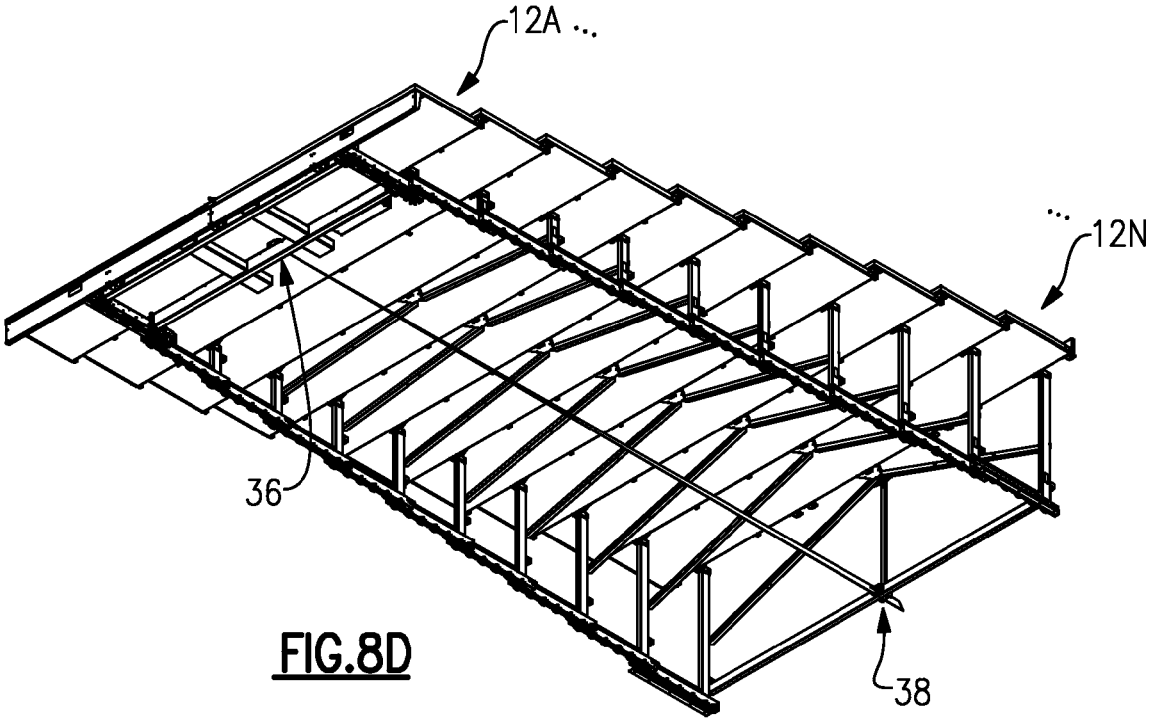
Figure 8E:
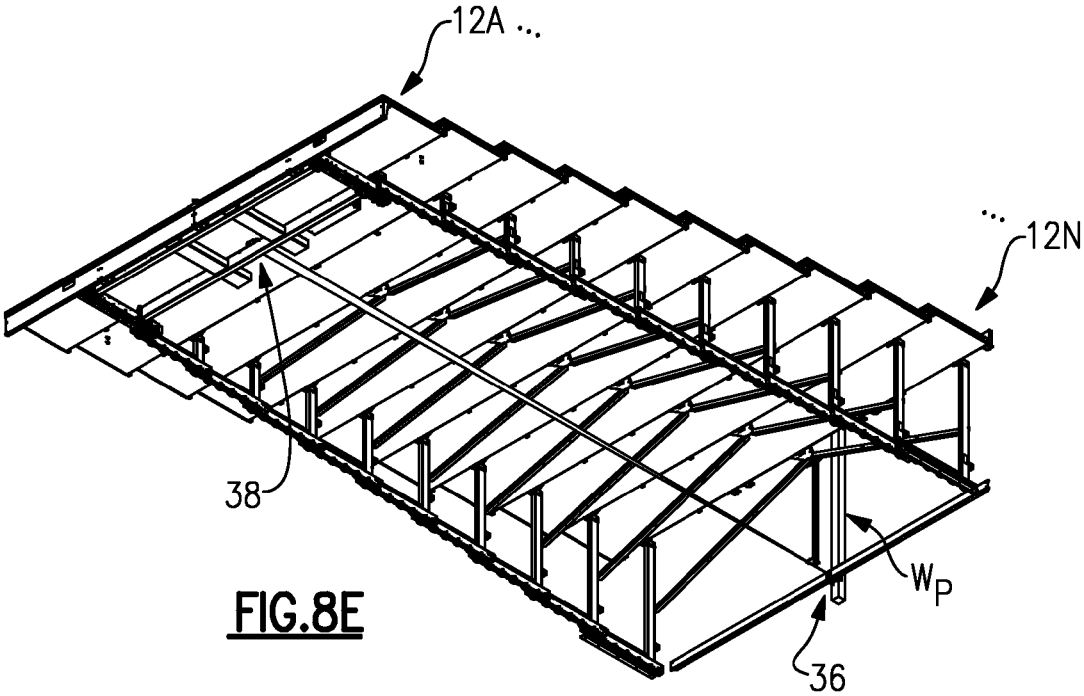
Figure 8F:
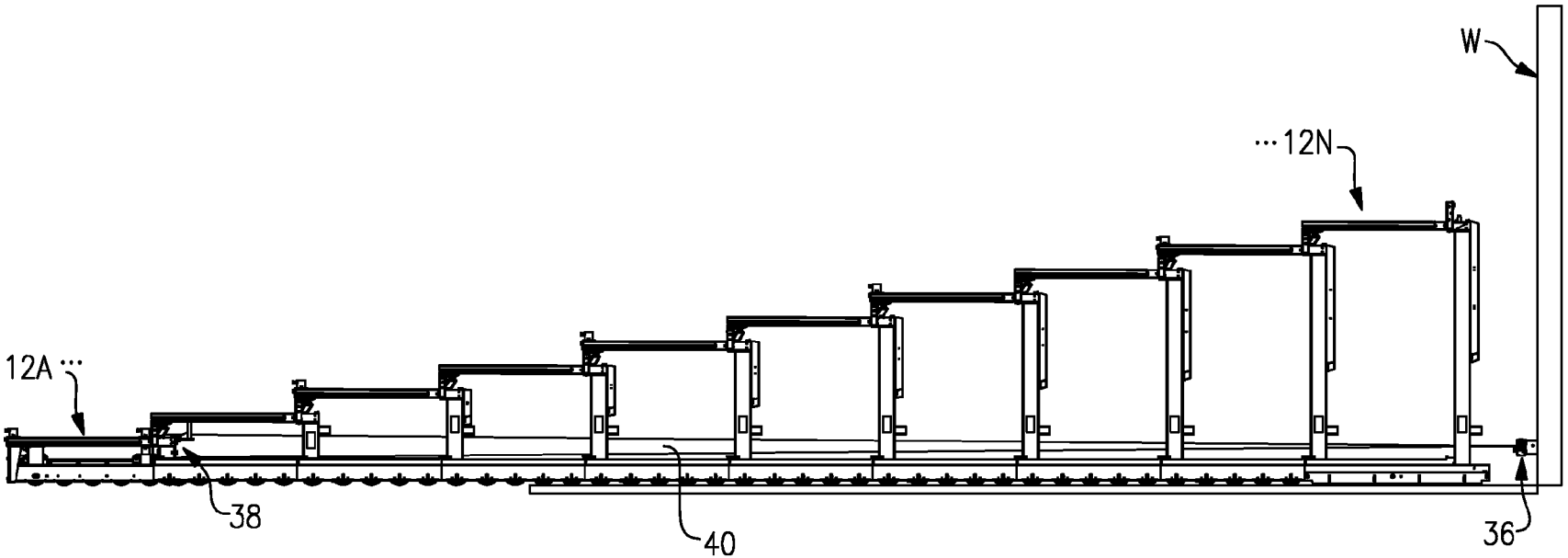

The laser 36 emits a laser beam 40 that may be a single point, straight-line beam, or may be a vertically fanned beam 40F (see FIG. 8C). It should be appreciated that other beams may be utilized.

Figure 9:
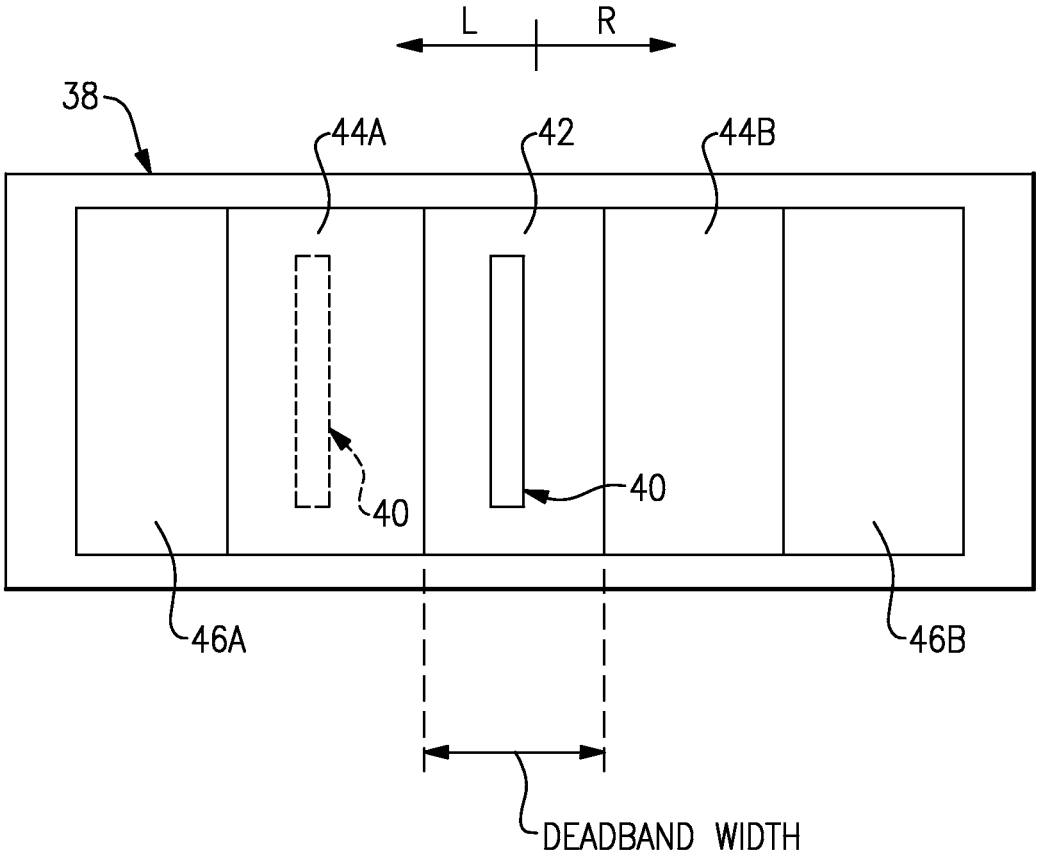
FIG. 9 is a schematic representation of the sensor.

With reference to FIG. 9, an example sensor 38 configuration is shown. The sensor 38 includes a central, alignment band 42 and first and second misalignment bands 44A-44B, 46A-46B on opposed sides of the alignment band 42. The alignment band 42 may have a predetermined width, referred to as a deadband width, to assure that the beam 40 is focused on the alignment band 42 regardless of minor irregularities (such as vibrations, or jitter, of the seating system 10) that may occur during deployment and retraction.

The bands 42, 44A-44B and 46A-46B in one example are provided by a pixel array which provides a variable frequency to the controller 30 depending on the location of the beam 40 on the array. Thus, in this example, the controller 30 can determine the location of the beam 40 on the array (including which band the beam 40 is focused within) depending on the frequency received from the sensor 38. The controller 30 can also define the width of the bands 42, 44A-44B, 46A-46B as being between a range of frequencies.

In one example, the controller 30 associates an alignment condition with a condition where the beam 40 is focused on the alignment band 42 (as shown in FIG. 9, the beam 40 is focused within the alignment band 42). A misalignment condition is identified when the beam 40 becomes focused on either of the first alignment bands 44A-44B or either of the second misalignment bands 46A-46B. In FIG. 9, a misalignment condition is represented in phantom, where the beam 40 is focused within the misalignment band 44A. In this regard, the width of the bands (including the deadband width) may be selected to correspond to conditions where binding is known or expected to occur. If the deadband width is too narrow, misalignment conditions would be identified too often, whereas if the deadband width is too large, misalignment conditions would be missed. Notably, more misalignment bands can be included.

The controller 30 is further operable to distinguish the first alignment bands 44A-44B from one another, and to distinguish the second alignment bands 46A-46B from one another, in order to identify a misalignment direction (e.g., right misalignment R or left misalignment L). The controller 30 is operable to steer the powered seating riser 12A based on the identified misalignment direction.

Further, the controller 30 is operable to steer the powered seating riser 12A at a rate corresponding to the severity of the identified misalignment condition. For example, if the beam 40 is focused on either of the second misalignment bands 46A-46B, the powered seating riser 12A may need to be steered at a higher rate to correct the more significant misalignment condition, compared to when the beam is focused on the first misalignment bands 44A-44B. In this context, steerage rate is defined as the angle at which the powered seating riser 12A is turned, and also may relate to the speed of the turn. For example, a higher steerage rate may relate to the powered seating riser 12A being driven at a sharper angle and a higher speed relative to a lower steerage rate.

Figure 10:
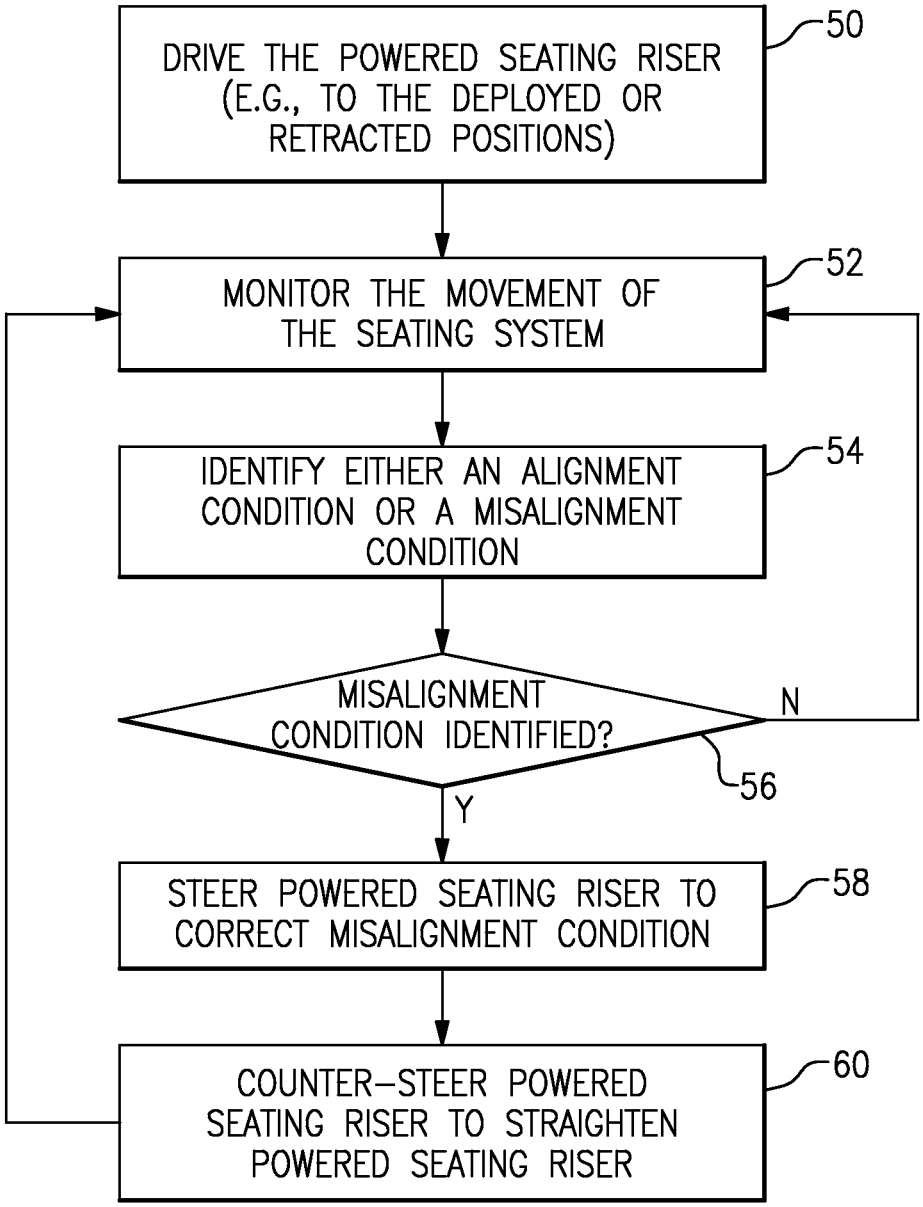
FIG. 10 is a flowchart diagram summarizing an example approach for controlling the seating system.

With reference to FIG. 10, information from the laser/sensor feedback loop 32 is provided to the controller 30 during deployment and retraction of the seating system 10 (e.g., at 50), such that the controller can monitor the movement of the seating system 10, at 52. The controller 30 in turn either identifies an alignment condition or a misalignment condition, at 54. If a misalignment condition is identified at 56, the controller 30 determines a direction, and a degree, of steering required to correct the misalignment condition. The controller 30 then instructs the belt drive system 16 accordingly, at 58, and the misalignment condition is corrected. Following correction of a misalignment condition, the controller 30 is further operable to counter-steer the powered seating riser 12A, at 60. The controller 30 then continues to monitor the movement of the seating system 10. If a misalignment condition is not identified at 56, the controller 30 continues to monitor the movement of the seating system 10, at 52. Notably, each of the steps shown in FIG. 10 are at least performed in part by the controller 30.

When the controller 30 identifies a misalignment condition, instructions regarding the steerage rate are transmitted to the belt drive system 16. For the single-belt drive system 16A, this includes an instruction to pivot the single-belt drive system 16A about the axis $P_A$ by a certain amount. For the dual-belt drive system 16B, this includes an instruction to adjust the relative speeds of the variable frequency drives 26A-26B.

Figure 11A:
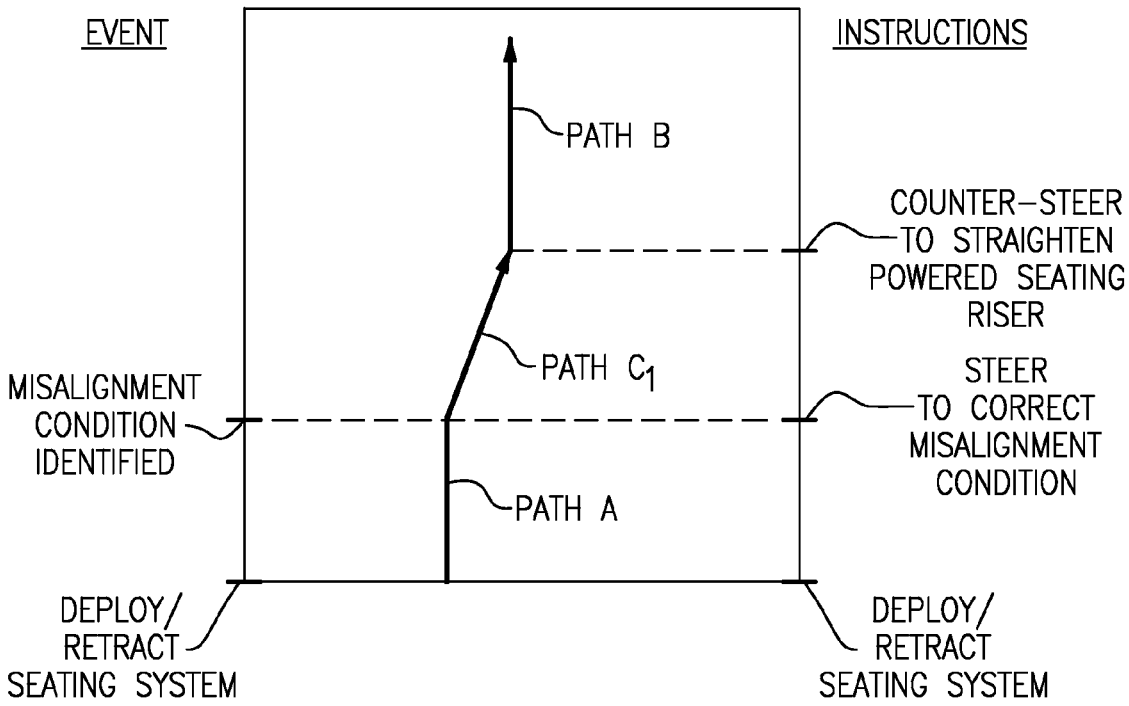
FIGS. 11A-11B are diagrams illustrating examples of relationships between events identified by the controller, and instructions corresponding to those events, as well as the path of the powered seating riser.
Figure 11B:
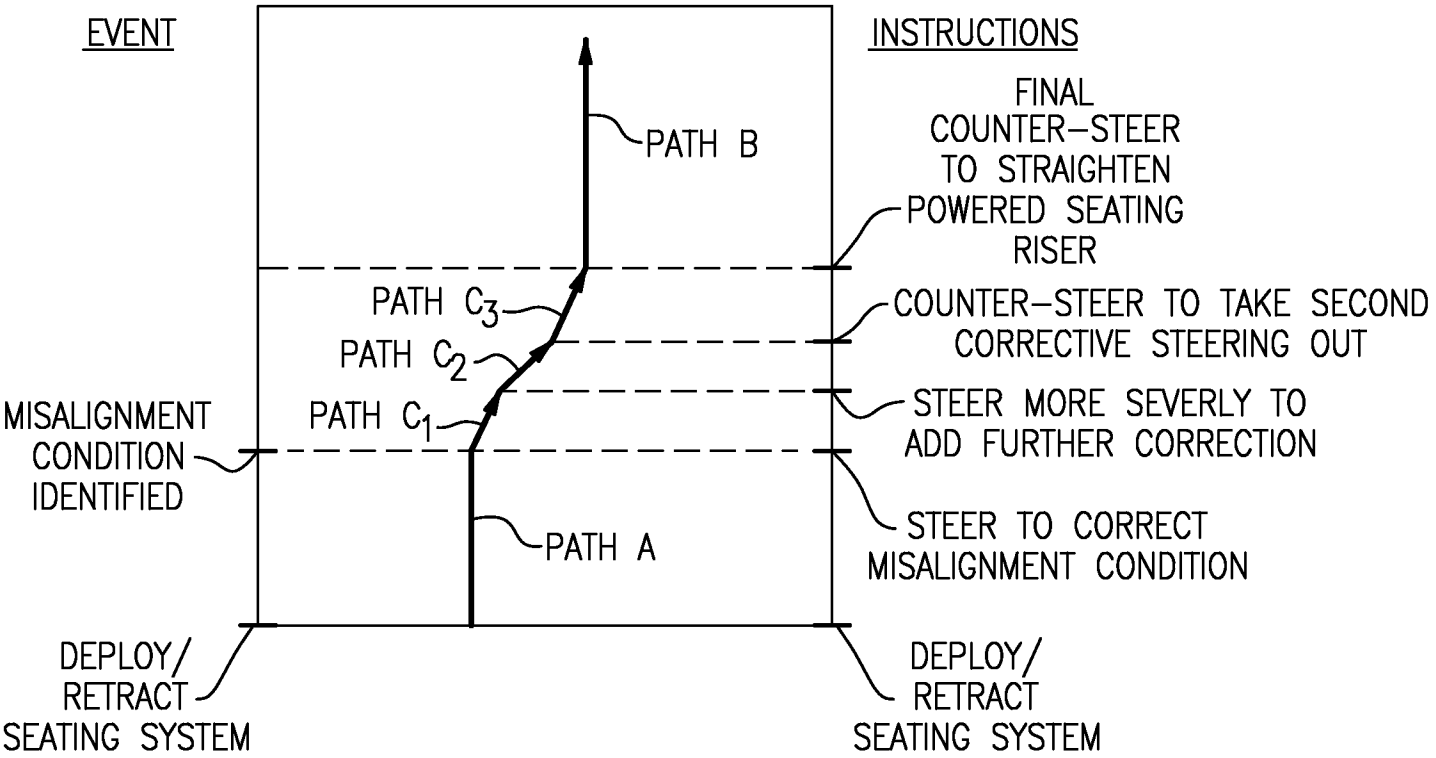

The steering instructions from the controller 30 can follow the schematic examples of FIGS. 11A-11B.

In the example of FIG. 11A, the powered seating riser 12A is instructed to deploy or retract the seating system 10 in a generally straight direction along path A. After some time, a misalignment condition is identified by the controller 30 when the beam 40 becomes focused on the first misalignment band 44A (e.g., as shown in phantom in FIG. 9). In response, the controller 30 instructs the belt drive system 16 to be steered in the right direction R at a corrective steerage rate, directing the powered seating riser along path $C_1$. If it is determined that the steerage of the powered seating riser 12A along path $C_1$ is correcting the misalignment condition, the powered seating riser 12A is counter-steered to essentially straighten the powered seating riser 12A, returning the powered seating riser 12A to a path B substantially parallel to its original path A. In this sense, the counter-steering essentially removes the correction which put the powered seating riser 12A on path $C_1$, and returns the powered seating riser 12A to a path parallel to its original path.

Notably, and with reference to FIG. 11B, in more severe misalignment conditions (e.g., if the beam 40 became focused on misalignment band 46A) the controller 30 can instruct the belt drive system 16 to be further steered in the right direction at a second, higher steerage rate (e.g., see path $C_2$) if the misalignment condition is not corrected by driving the powered seating riser 12A along path $C_1$. In this example, the powered seating riser 12A is steered along path $C_1$, and then to $C_2$. If it is determined that the steerage along path $C_2$ is correcting the misalignment condition, the powered seating riser 12A may be counter-steered to a path $C_3$ which is generally parallel to path $C_1$ to remove the correction which put the powered seating riser along path $C_2$. The powered seating riser 12A may then be corrected to return to a path B which is generally parallel to the original path A to remove the steering correction which put the powered seating riser 12A on path $C_1$.

It should be understood that the powered seating riser 12A can be correctively steered more than two times (e.g., to a corrective steering path more severe than path $C_2$), and in some examples the powered seating riser 12A is correctively steered up to six times to attempt to correct the misalignment condition. In these examples, the powered steering riser 12A would be incrementally counter-steered to remove these corrections (as in the examples of FIGS. 11A-11B). In some examples, the counter-steering increments are equal in degree and timing to the corrective steering increments, as well as the time the corrective steering is applied. That is, in the example of FIG. 11B, the powered seating riser 12A could have been turned from 10 degrees to 15 degrees to get from path $C_1$ to $C_2$, and driven along path $C_2$ for two seconds. To remove this corrective steer, the powered seating riser 12A is turned back from 15 degrees to 10 degrees to move from path $C_2$ to $C_3$ and driven for two seconds along path $C_3$. This is, again, just a single example, and the powered seating riser 12A can be driven in other ways to prevent misalignment conditions.

The control system 30 may include a module that executes a deployment/retraction algorithm (FIG. 10). It should be understood that the functions of the algorithm may be enacted in either dedicated hardware circuitry or program software routines capable of execution in a microprocessor-based electronics control embodiment. The module thus typically includes a processor, a memory, and an interface. The processer may be any type of known microprocessor having desired performance characteristics, the memory may include various types of computer readable mediums which store data in the control algorithms describe herein, and the interface which facilitates communications with other systems such as the laser 36, the sensor 30, power inputs as well as communication with off-board computing devices such as a laptop or other system to provide programming updates, etc.

Figure 27:
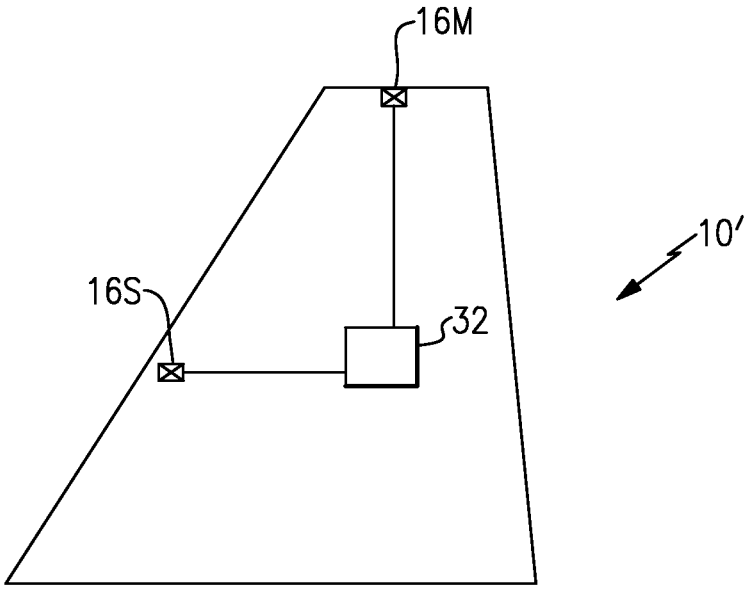
FIG. 27 is an example of a seating system including more than one belt drive system.

The steerage provided by belt drive system 16 may be on the order of, for example, plus or minus 10 percent (10%) so as to bias the deployment and retraction direction of the powered seating riser 12A. It should be understood that although single-belt and dual-belt drive systems 16A-16B have been discussed, additional drive systems may be included with the powered seating riser 12A to provide desired power (e.g., as shown in FIG. 27).

Roller/Guide

Figure 12A:
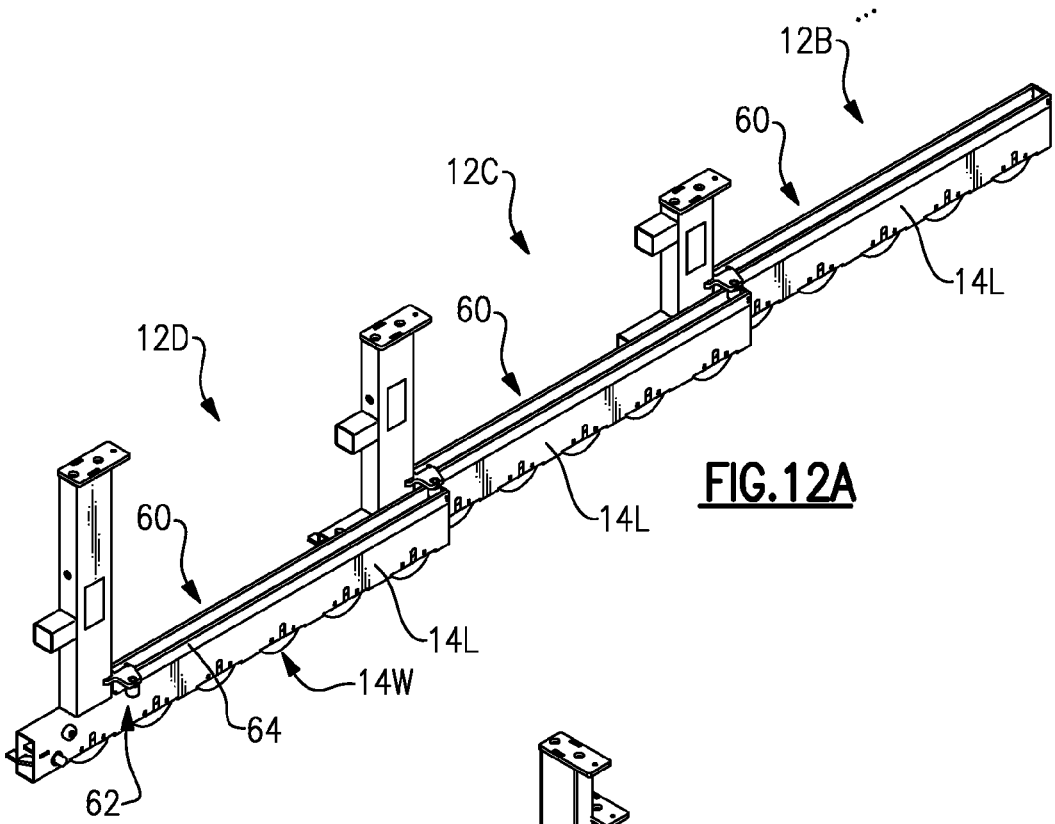
FIG. 12A is representative of the legs of adjacent seating risers in the deployed position.
Figure 12B:
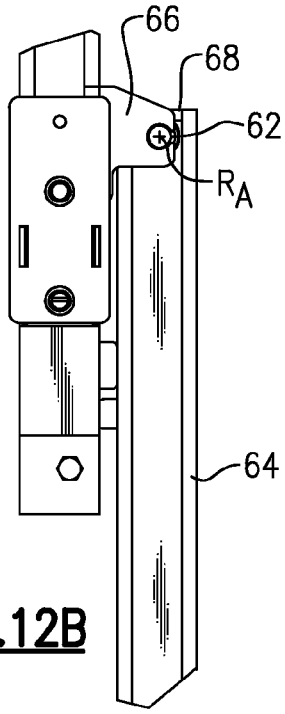
FIG. 12B is a top view of two adjacent legs, showing the arrangement of a roller in a channel.
Figure 13:
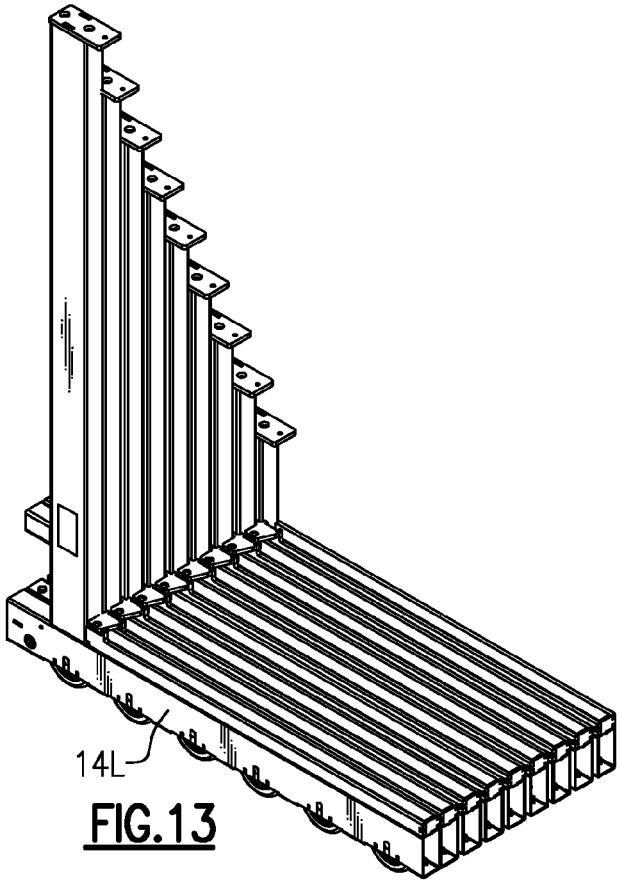
FIG. 13 is representative of the legs of adjacent seating risers in the retracted position.

To further prevent binding of the seating system during retraction and deployment, the legs 14L of the seating risers 12A-12F each include a roller/guide assembly 60, as illustrated in FIG. 12A. Each roller/guide assembly 60 includes a roller 62 and a guide, or channel 64. As shown in FIG. 12B, the roller 62 of an interior leg may project outward via a flange 66 such that the roller 62 is aligned within a channel 64 of an exterior, adjacent leg 14L. That is, the combination of the flange 66 and the roller 62 generally define an L-shaped structure, allowing the roller 62 to cooperate with the robust channel 64. Accordingly, the interior leg 14L is permitted to travel between the retracted position (generally shown in FIG. 13) and the deployed position (generally shown in FIG. 12A) in which the roller 62 abuts a stopper 68 disposed at the end of the corresponding channel 64.

It should be noted that the arrangement of the roller 62 and the channel 64 could be reversed, and the roller 62 could project inward from an exterior leg 14L (by way of a flange similar to the flange 66, for example) to travel within the channel of an interior adjacent leg 14L.

Further, the roller 62 and channel 64 arrangement discussed above could be incorporated into manual seating systems that do not include a powered seating riser 12A.

Leg Lock Assembly

Figure 14:
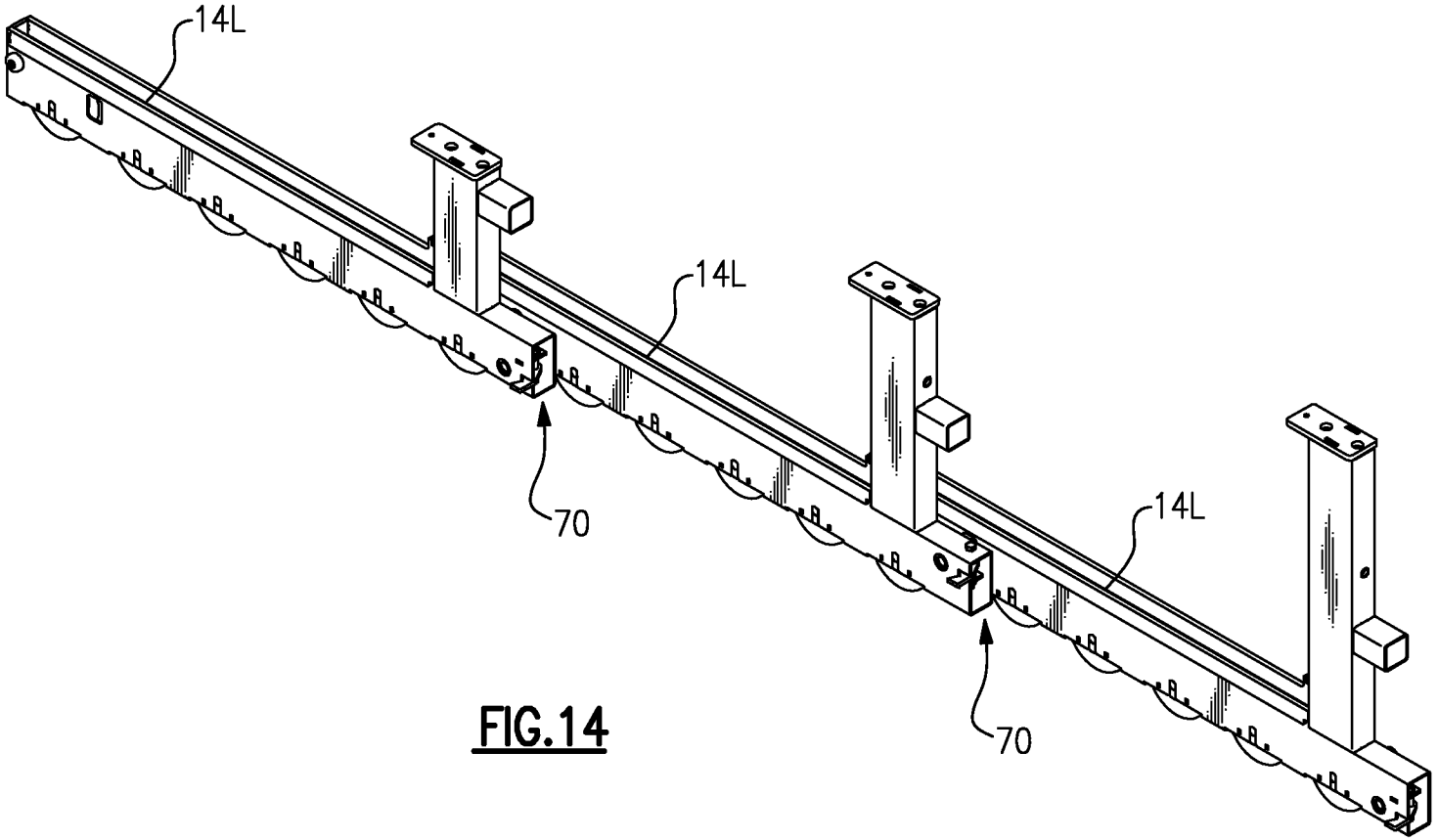
FIG. 14 is a rear-perspective view of legs having locks arranged thereon.

With reference to FIG. 14, the legs 14L of the seating system 10 may optionally include a lock 70 to lock adjacent legs 14L relative to one another when deployed. It should be understood that is possible to incorporate a locking feature such that the legs 14L lock relative to one another when in the retracted position of FIG. 12A as well.

Figure 15A:
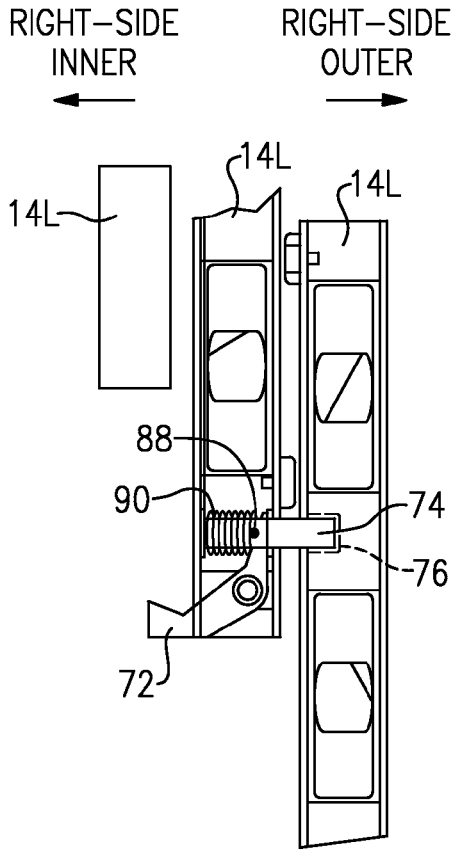
FIGS. 15A-15B illustrate the lock during and after engagement with an adjacent leg, respectively.
Figure 15B:
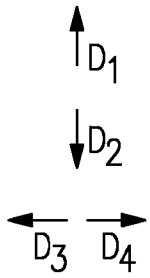
Figure 15B:
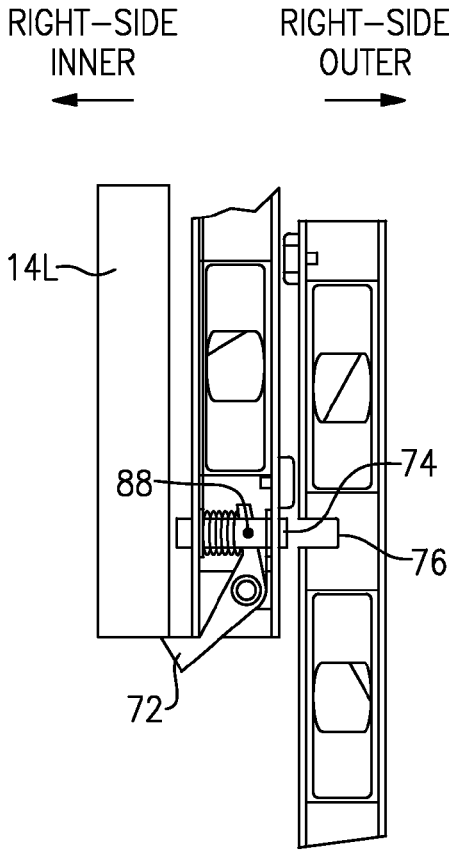

The locks 70 each include a lever arm 72, as well as a lock pin 74. The lock pin 74 is engageable with a window, or slot, 76 in an outer adjacent leg 14L to lock the middle and outer legs 14L relative to one another. As shown in the example of FIG. 15A, the middle leg 14L is in the deployed position, and is locked relative to the outer leg 14L by way of the lock pin 74 being received in a window 76 of the outer adjacent leg 14L. As shown in FIG. 15B, the inner adjacent leg 14L, upon movement to the inner adjacent riser to the retracted position (e.g., toward direction $D_2$), abuts the lever arm 72 of the middle leg 14L and in turn the lever arm 72 moves the lock pin 74 in a direction $D_3$ (which is generally perpendicular to directions $D_1$ and $D_2$) against the bias of the spring 90 to direction $D_4$, to remove the pin 74 from the window 76, and allow the riser associated with the middle leg 14L to move relative to the outer adjacent leg 14L to the retracted position.

Figure 16:
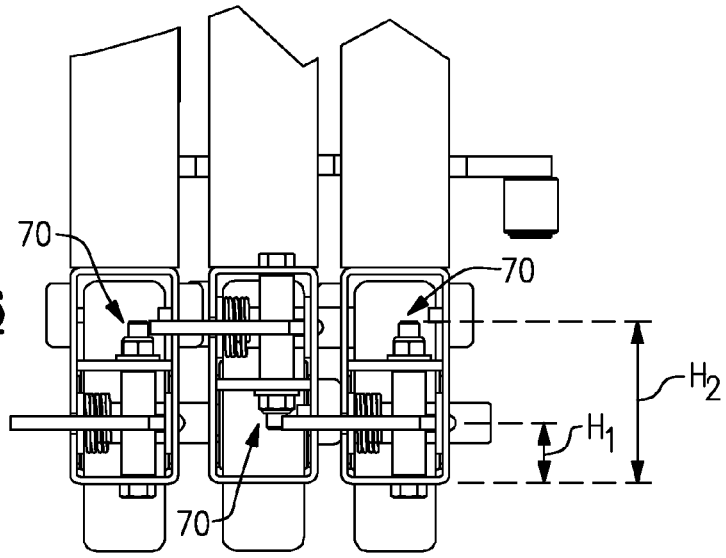
FIG. 16 is a rear view of adjacent legs, showing the relative arrangement of the locks in detail.
Figure 17A:
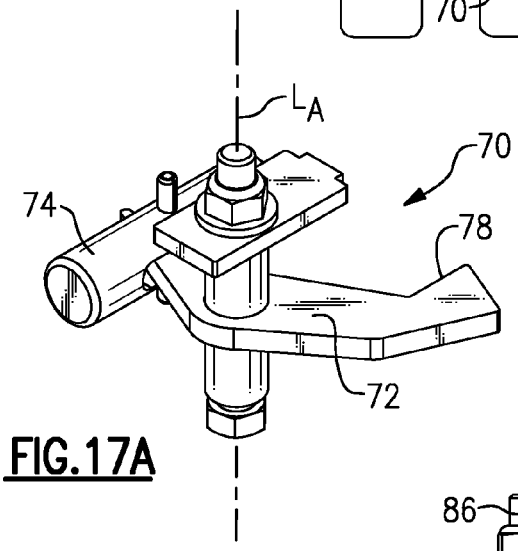
FIGS. 17A-17E are various views of an example lock.
Figure 17B:
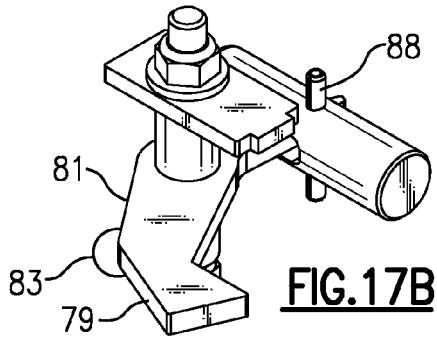
Figure 17C:
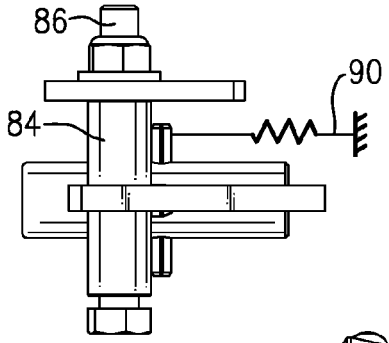
Figure 17D:
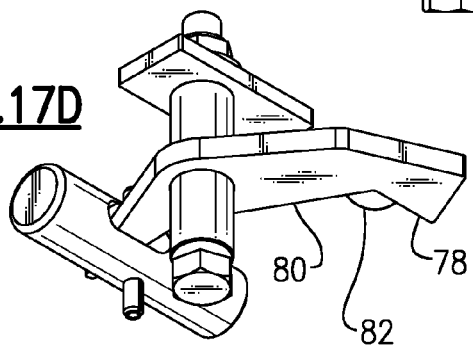
Figure 17E:
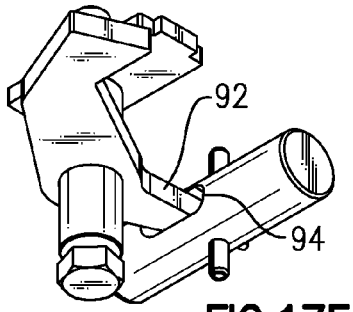

It should be noted that each of the legs 14L can include an individual lock 70. The outermost leg does not need a lock, as it may be associated with a fixed riser, however the outermost leg may include a lock if needed. Further, to avoid interference between the locks 70 of the adjacent legs 14L, the locks 70 may be oriented at different heights H1, H2 as generally illustrated in FIG. 16.

An example lock 70 is shown in further detail across FIGS. 17A-17E. The lock 70 includes an abutment face 78 configured to abut with the inner adjacent leg 14L as shown in FIG. 16B. The lever arm 72 further includes a main body portion 80 extending from the abutment face 78 at an obtuse angle 82 less than 180°. The lever arm 72 further includes rear contour faces 79, 81 generally opposite the abutment face 78 and main body portion 80, respectively, arranged at an obtuse angle 83 greater than 180°. The lever arm 72 includes a sleeve 84 configured to allow rotation of the lever arm 72 about a rotation pin 86 defined about a locking axis $L_A$.

The lock pin 74 further includes a spring retention member 88 to generally retain a spring 90 against an interior wall of the leg 14L. In general, the spring 90 is configured to retain the lock pin 74 in an outer direction (e.g., direction $D_4$ in FIGS. 15A-15B). Upon engagement of an inner adjacent leg 14L with the lever arm 72, the force transmitted from the lever arm 72 to the lock pin 74 is sufficient to overcome the bias of the spring 90, and thus permits deployment of the lock pin 74 (e.g., as illustrated in FIGS. 15A-15B).

The lever arm 72 further includes a tip 92 sized to be received in a slot 94 of the lock pin 74. In this manner, rotation of the lever arm 72 about the locking axis $L_A$ translates into movement of the locking pin in the directions $D_3$, $D_4$.

It should be understood that the lock 70 extends to manual seating systems that do not include a powered seating riser 12.

Nose Mounted Deck—Extrusion Profile

Figure 19A:
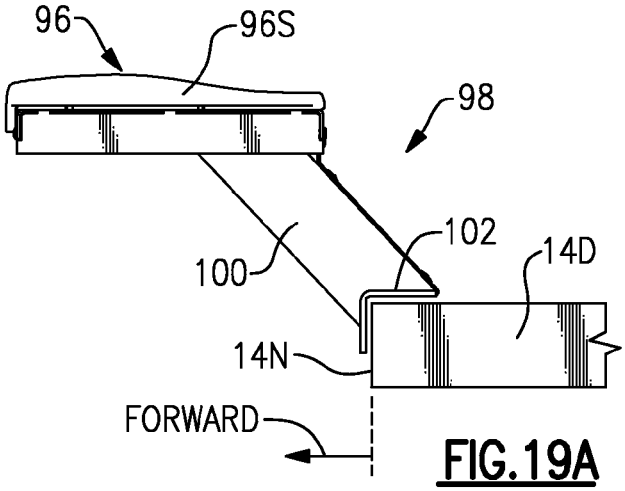
FIGS. 19A-19B illustrate an exemplary manner in which the seating bench of FIGS. 18A-18B is arranged on the deck of the seating risers.
Figure 19B:
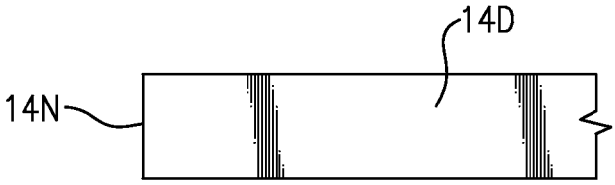

In the example where the decks 14D support a plurality of permanent seats thereon, an example seating bench 96 (FIGS. 18A-18B) may be affixed to each of the decks 14D such that the seating bench 96 (which may include a plurality of seat pans 96S) is supported at a position generally forward of the decks 14D. That is, at least a portion of the seating bench 96 (and the seat pans 96S) is located forward of a nose 14N of the decks 14D via a support bracket 98 including a number of arms 100 and brackets 102. In one example, and as illustrated in FIG. 19A, the seating bench 96 is located entirely forward of the nose 14N of the deck. Supporting the seating bench 96 in this forward manner generally allows the seating system 10 to incorporate a relatively large number of seating risers 12A-12N into a space of a fixed height $H_3$.

Figure 20:
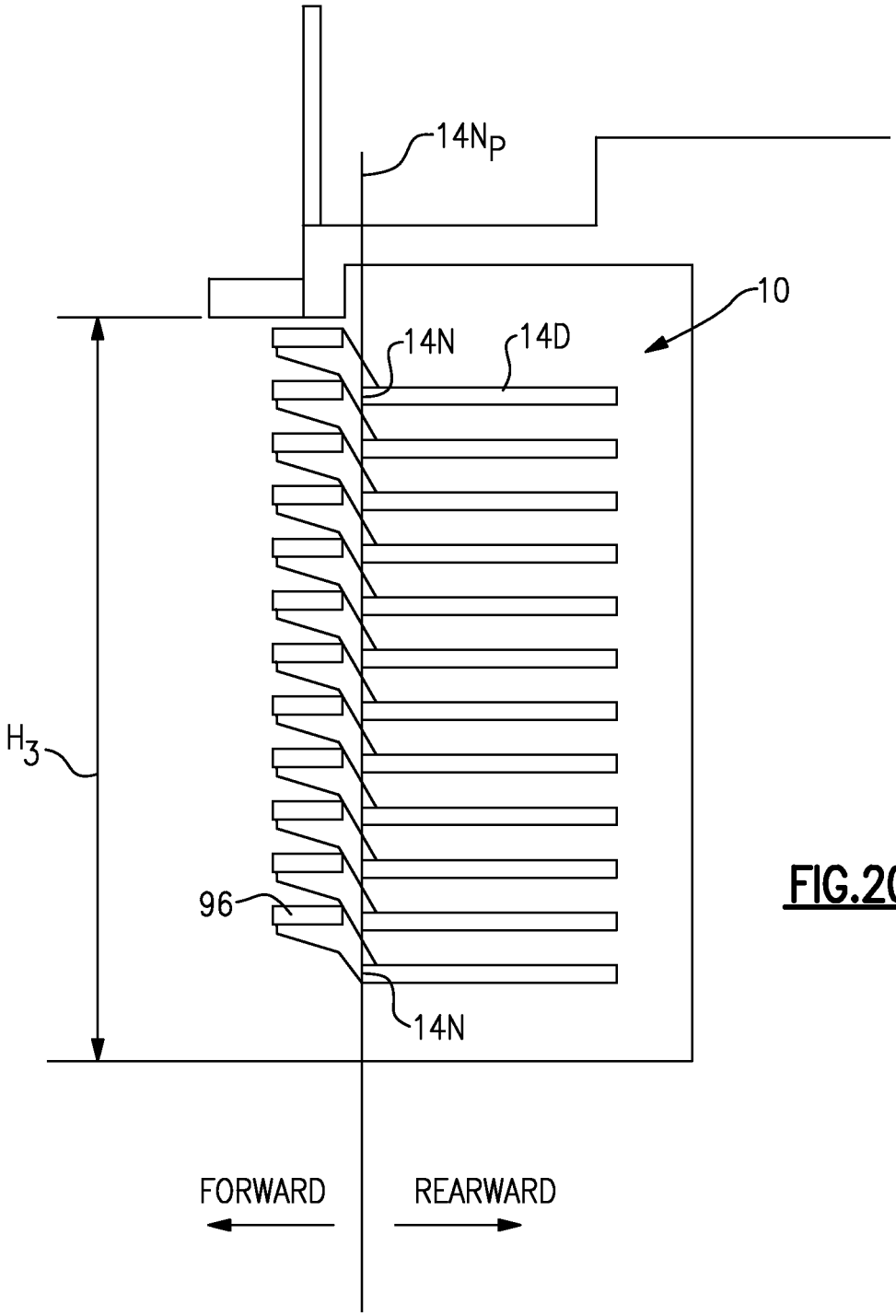
FIGS. 20-21 illustrate risers including the seating bench of FIGS. 18A-18B in the retracted and deployed positions, respectively.

For example, as illustrated FIG. 20, the seating system 10 can be retracted into a space of a fixed height $H_3$ such that the seating bench 96 is positioned generally forward of a plane defined by the nose of the decks 14$N_P$. In the example of FIG. 20, seating bench 96 is positioned such that the entirety of the seating bench 96 (and the seat pans 96S, if included) is forward of the plane defined by the nose of the decks 14$N_P$. Accordingly, the seating system 10 can tightly nest within a limited space, or height, $H_3$ while still providing a relatively large amount of seating.

Figure 21:
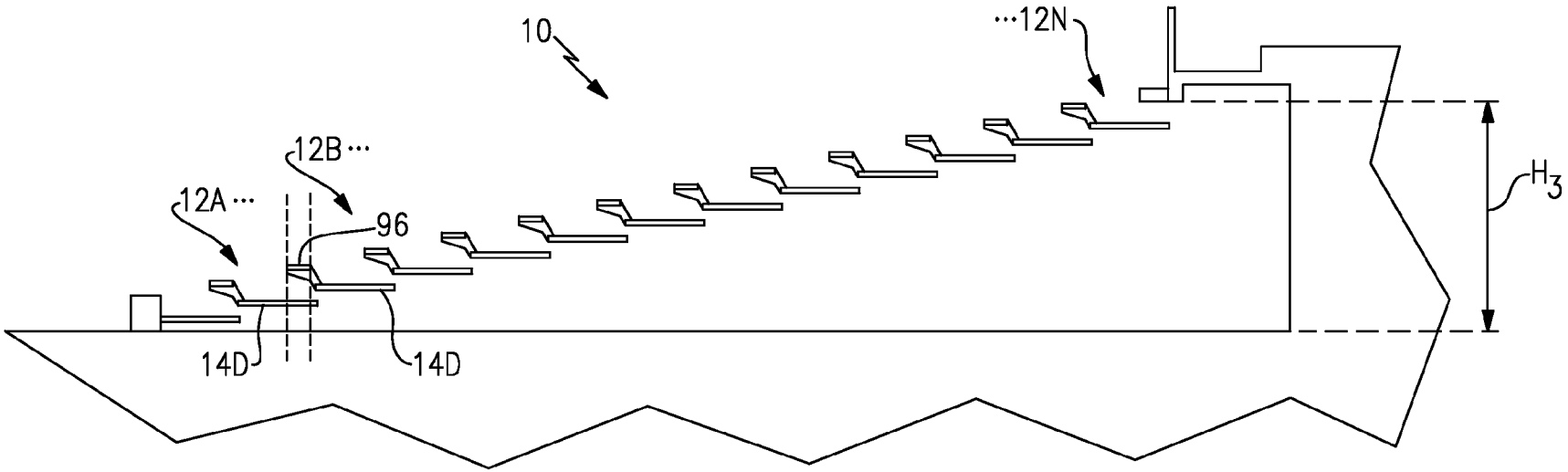

Further, when deployed (FIG. 21), each seating bench 96 is located above a lower deck 14D to provide a comfortable seating space. That is, as shown, the entirety of each of the seating benches 96 is vertically aligned a lower deck 14D (with the exception of the seating bench 96 of the powered seating riser 12A). Again, a relatively large amount of seating is provided without sacrificing the space, and comfort, available to users.

Figure 22A:
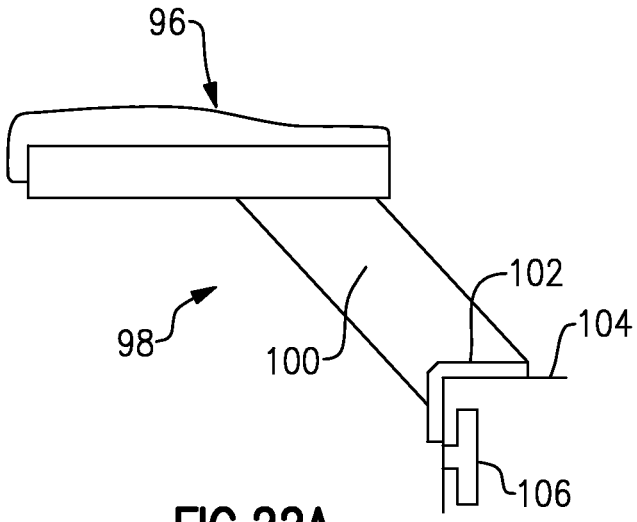
FIG. 22A illustrates another exemplary seating bench.
Figure 22B:
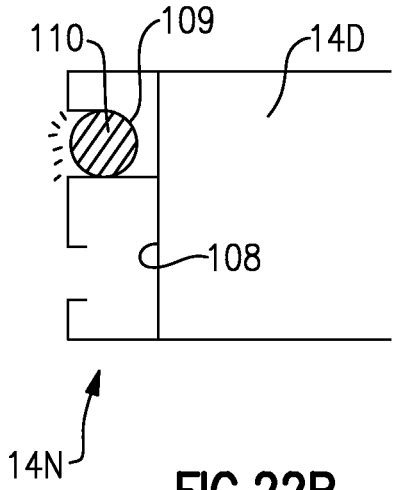
FIG. 22B is representative of an example nose extrusion for the deck of the seating risers.

FIGS. 22A-22B show an alternate configuration for mounting the seating bench 96 to the decks 14D. In this example, the support brackets 98 extend forward of the deck 14N in a manner similar to that shown in FIG. 19A, however the brackets 102 include an attachment 104 having an alignment feature 106. The nose 14N of the deck 14D further includes an extrusion profile with a corresponding alignment feature 108. The extrusion alignment features 106, 108 can further insure alignment of the seating bench 96 during attachment, and can further provide support to the seating bench 96. Optionally, the extrusion profile can include an upper cavity 109 for supporting LED lights 110 therein (such as a strand of LED lights). The lights 110 can be oriented to illuminate the decks 14D along an aisle way to increase visibility as people walk therealong. The lights 110 can further be selected of a color, such as a team color, to add to the overall aesthetics of the seating system 10.

The seating bench 96 may be formed of an extruded steel plank, and seat pans 96S may be provided by plastic seat pans attached to the extrusion. The seating bench 96 need not include the seat pans 96S, and can stand provide seats itself.

In this context, a seat refers to the seating bench 96, with or without the added seat pans 96S.

It should be understood that the features relating to the arrangement of the seating bench 96 and the nose of the deck 14N (as well as to the extrusion profiles and lighting) extend to manual seating systems, as well as to seating systems that include risers that do not telescope relative to one another.

Bank Control

Figure 23:
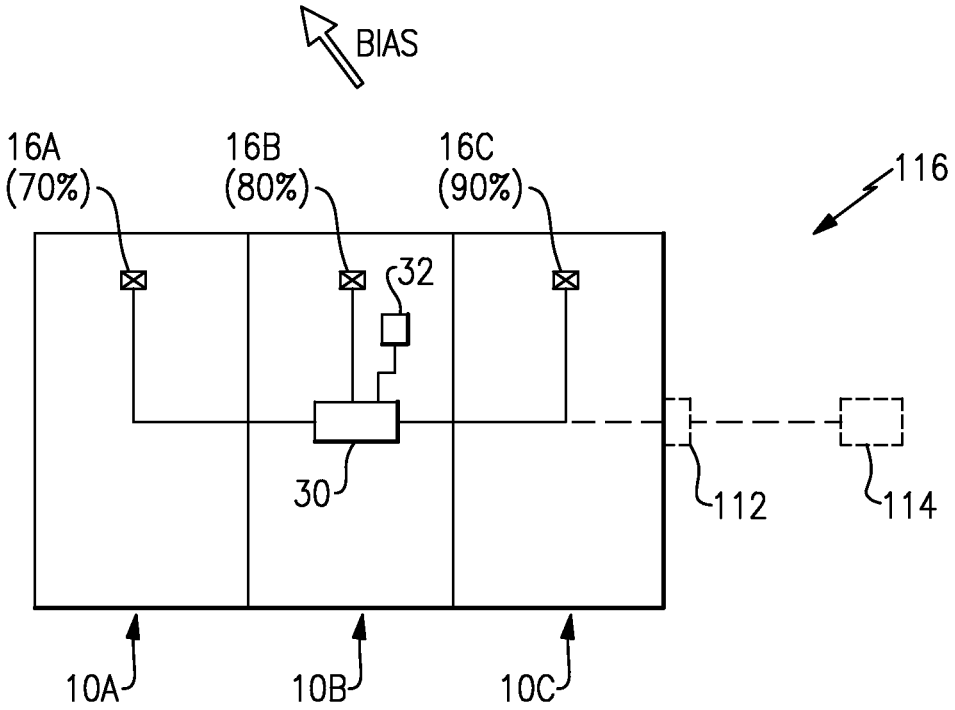
FIG. 23 illustrates a seating bank.
Figure 24:
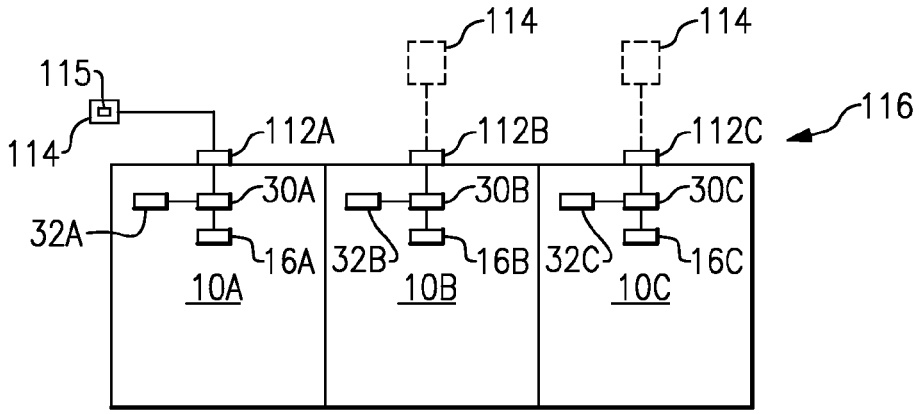
FIG. 24 illustrates a seating bank and a control pendant for use therewith.

The seating system 10 may stand alone, or be side-by-side or linked with other seating systems (e.g., seating systems 10A, 10B, 10C) to define a seating bank 116. With reference to FIG. 23, each seating system 10A, 10B, 10C of the seating bank 116 includes an individual drive system 16A, 16B, 16C controlled by a common controller 30. In another embodiment, each seating system 10A, 10B, 10C may include separate, individual controllers 30A, 30B, 30C (FIG. 24).

Deployment of the seating bank 116 may be effectuated such that each seating system 10A, 10B, 10C deploys independent of the others, or they may be deployed together. When deploying the seating systems 10A, 10B, 10C together, a multiple of drive systems 16A, 16B, 16C may utilize a single laser/sensor feedback loop 32 and be driven at, for example, a nominal 80 percent of the drive system power capability. To control deployment of the multi-seating bank system 116, the motive force of the outboard drive systems 38A, 38C, are thus powered relative to the guided drive system 38B.

For example, to adjust the seating bank 116 to have a leftward bias during deployment, the drive system 16A may be powered at, for example, 70 percent, while the drive system 16C is powered at, for example, 90 percent power. The differential will thereby provide a leftward bias during deployment of the relatively wide multi-seating bank system 116 which may be, for example, over 30 feet in width.

Control Pendant

Figure 25:
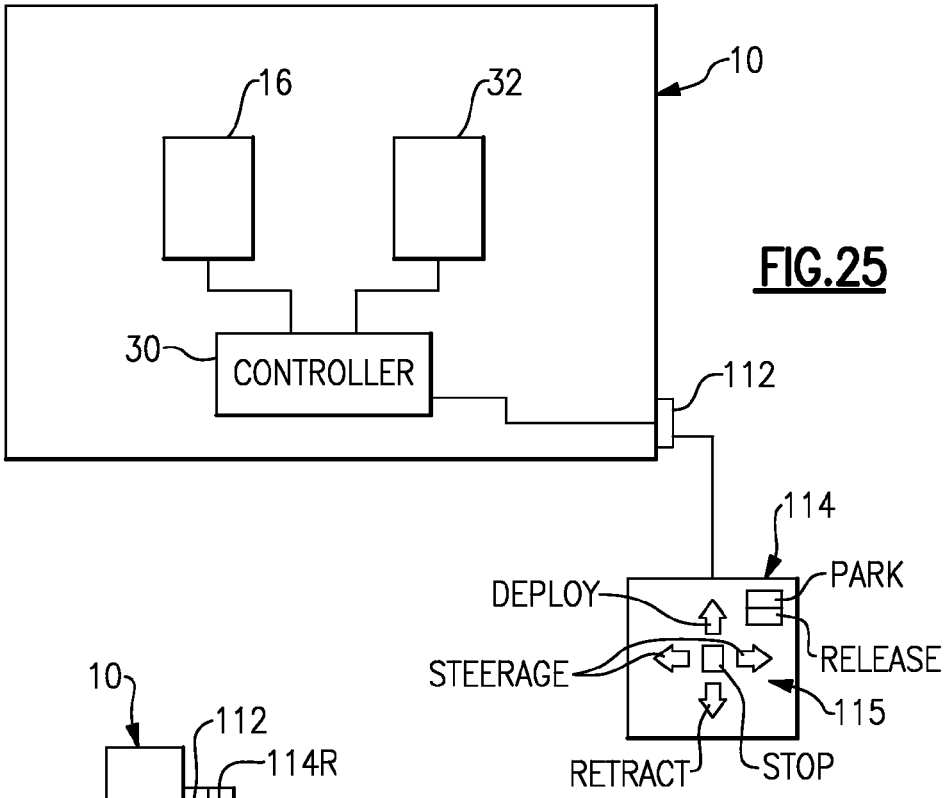
FIG. 25 is representative of the manner in which the disclosed control pendant may be arranged relative to a seating system.

An optional control pendant 114 can communicate user-inputs, or initiating signals, to the disclosed controller 30, as schematically represented in FIG. 25.

The user-inputs may include, but are not limited to, a deployment command, a retraction command, and a stop command. The controller 30 is operable to instruct the drive system 16 in a manner consistent with the commands from the control pendant 114. Other optional commands include steerage override commands (e.g., such that a user can steer the powered seating riser 12A independent of the alignment and misalignment conditions identified by the controller 30), and park and release commands where the belt drive system 16 essentially parks powered seating riser 12A (e.g., similar to the deployment of a parking brake in an automobile). The user-inputs are represented in FIG. 25 as seating system controls 115.

In one example, the control pendant 114 is attachable and removable from a port 112 such that the seating system controls 115 are capable of being detached from the seating system 10 when desired. This way the seating system 10 can only be adjusted by those with access to the control pendant 114, and those without authority to adjust the seating system 10 would not have access to a control panel fixed directly thereto, for example.

In this manner, when the control pendant 114 is removed from the port 112, the seating system 10 is said to be SAFED such that it is "safe" from being further adjusted until the control pendant 114 is again coupled to the port 112. In other words, when SAFED, the control pendant 114 is prevented from communicating with the controller 30.

Figure 26:
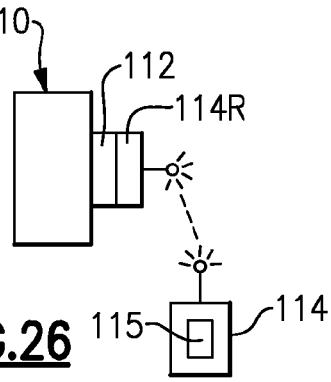
FIG. 26 illustrates a wireless communication between a control pendant and a seating system.

The control pendant 114 may communicate wirelessly with a receiver 114R, which is removably attached to the port 112, as in FIG. 26. Removal of the receiver 114R from the port 112 renders the associated seating system 10 SAFED. While a wireless receiver 114R is shown, the control pendant 114 could communicate with the port 112 by way of a wire, however.

A single control pendant 114 may also be used to deploy an entire seating bank 116 (such as that of FIG. 23), or to independently deploy a number of seating systems 10A, 10B, 10C. With reference to FIG. 24, the control pendant 114 is capable of independently communicating with each seating system 10A, 10B, 10C via a respective port 112A, 112B, 112C. As illustrated, the control pendant 114 is in communication (either wirelessly or otherwise) with seating system 10A via port 112A, while seating systems 10B and 10C are SAFED. Once seating system 10A is adjusted as desired, a user may then connect the control pendant 114 to seating system 10B, rendering seating systems 10A and 10C SAFED.

If a wireless control pendant 114 is used, each seating system 10A-10C may include a separate receiver 114R, and the control pendant 114 may be capable of selectively communicating with the appropriate receiver. Alternatively, a single receiver 114R could be used between each of the seating systems 10A-10C, in which case a user would selectively couple the receiver to an appropriate one of the seating systems 10A-10C (e.g., the one the user intends to control).

Further, and while the seating system 10 may include a single belt drive system 16, other seating systems may benefit from additional drive systems. For example, and with reference to FIG. 27, the seating system 10' is of a rectilinear shape to, for example, fit within corner areas of a stadium or arena. The seating system 10' may be more difficult to deploy/retract given this overall shape, and thus it includes a master drive system 16M (which provides steerage as described above) and a slave drive system 16S which does not provide steerage, but provides additional motive force for the seating system 10. A single control system 30 controls the master drive system 16M (to steer the powered seating riser 12A as described above) and power the slave drive system 16S to facilitate deployment and retraction of the seating system 10.

The decks 14D may be manufactured of any suitable material. In one example, the decks 14D include upper and lower deck skins which sandwich a core. In the example, the skins are manufactured of aluminum while the core is formed of an end-grained balsawood or a honeycomb structure to provide a strong, lightweight and acoustically absorbent structure.

It will be appreciated that seating system 10 is a load bearing structure intended to hold many people and equipment, such as portable seating, above a floor surface. Therefore, the seating system 10 is suitably constructed. For instance, the support structure 14 may be constructed of thin wall tubing, straight bar stock, right angle bar stock, and plates of suitable materials, for instance, steel, alloy, aluminum, wood or high strength plastics. Components may be joined in any number of conventional manners, such as by welding, gluing or with suitable fasteners. The rollers may be of the solid caster type.

While the seating risers 12A-12F are shown to deploy and retract serially, in order, a locking mechanism or other interface may additionally be provided so that only particular seating riser assemblies 12A-12F are deployed. In one example, only every other riser is deployed to provide a desired rise. The locking mechanism may be of various mechanical or electrical forms which interlock various combinations of riser assemblies 12A-12F.

While the disclosed system has been referred to as a seating system, the term seating system extends to systems that are solely intended for use as risers, to support standing spectators or performers without seats.

The disclosed system provides venues with functional and efficient risers that are capable of accommodating various needs.

It should be understood that relative positional terms such as "forward," "aft," "upper," "lower," "above," "below," and the like are with reference to the normal operational attitude of the system and should not be considered otherwise limiting.

Although the different examples have the specific components shown in the illustrations, embodiments of this invention are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A seating system comprising:

a plurality of seating risers configured to telescope relative to one another, wherein at least one of said seating risers is a powered seating riser configured to deploy and retract said seating risers; and a control pendant, said powered seating riser drivable in response to said control pendant, wherein said control pendant communicates with a controller in communication with said powered seating riser via a removable receiver, wherein said controller is operable to deploy said seating risers in a first direction in response to a deployment signal, retract said seating risers in a second direction in response to a retraction signal, and stop movement of said seating risers in response to a stop signal, and wherein said controller is operable to steer said seating riser laterally, in addition to said first and second directions, and at least partially independently of an initiating signal from said control pendant.

2. The seating system of claim 1, wherein said deployment signal extends said powered seating riser.

3. The seating system of claim 1, wherein said controller is operable to steer said powered seating riser and facilitate alignment of said seating riser.

4. The seating system of claim 1, wherein said control pendant wirelessly communicates with said controller via a receiver.

5. The seating system of claim 1, further including a port in communication with said controller, and a receiver removably attached to said port.

6. The seating system of claim 5, wherein said control pendant is only permitted to communicate with said controller when said receiver is attached to said port.

7. The seating system of claim 5, wherein, when said receiver is removed from said port, said seating system is SAFED such that said control pendant is prevented from communicating with said controller.

8. The seating system of claim 1, wherein said controller steers said powered seating riser in response to information from a feedback loop including a laser and a sensor.

9. The seating system of claim 8, wherein one of said laser and said sensor is mounted to said powered seating riser.

10. The seating system of claim 5, wherein said receiver is removable such that it can be temporarily removed and replaced when desired.

* * * * *